US011167333B2

(12) United States Patent
Fiorucci

(10) Patent No.: US 11,167,333 B2
(45) Date of Patent: Nov. 9, 2021

(54) COIL FORMING LAYING HEAD SYSTEM

(71) Applicant: RUSSULA CORPORATION, Fiskdale, MA (US)

(72) Inventor: Keith Fiorucci, Sturbridge, MA (US)

(73) Assignee: RUSSULA CORPORATION, Fiskdale, MA (US)

( * ) Notice: Subject to any disclaimer, the term of this patent is extended or adjusted under 35 U.S.C. 154(b) by 246 days.

(21) Appl. No.: 16/404,786

(22) Filed: May 7, 2019

(65) Prior Publication Data

US 2019/0337035 A1 Nov. 7, 2019

Related U.S. Application Data

(60) Provisional application No. 62/668,040, filed on May 7, 2018.

(51) Int. Cl.
*B21C 47/14* (2006.01)
*B65H 57/12* (2006.01)

(52) U.S. Cl.
CPC ..... *B21C 47/143* (2013.01); *B65H 57/12* (2013.01)

(58) Field of Classification Search
CPC ..... B21C 47/143; B65H 57/12
See application file for complete search history.

(56) References Cited

U.S. PATENT DOCUMENTS

| | | | |
|---|---|---|---|
| 4,242,892 | A | 1/1981 | Wykes et al. |
| 4,765,556 | A | 8/1988 | Nasrah |
| 5,590,848 | A | 1/1997 | Shore et al. |
| 6,769,641 | B2 | 8/2004 | Pariseau et al. |
| 2013/0048773 | A1 | 2/2013 | Titus et al. |
| 2013/0112796 | A1 | 5/2013 | Vasi et al. |
| 2014/0070039 | A1 | 3/2014 | Shen et al. |
| 2016/0207087 | A1 | 7/2016 | Fiorucci |

FOREIGN PATENT DOCUMENTS

| | | | |
|---|---|---|---|
| CN | 104289556 | B | 3/2016 |
| EP | 0679453 | A1 | 11/1995 |
| JP | 2003073032 | A | 3/2003 |
| JP | 2003205313 | A | 7/2003 |
| KR | 20040014849 | A | 2/2004 |
| WO | 2014042926 | A1 | 3/2014 |

OTHER PUBLICATIONS

International Search Report and Written Opinion for PCT/US2019/031005, dated Aug. 20, 2019, 12 pages.

*Primary Examiner* — William E Dondero
(74) *Attorney, Agent, or Firm* — Abel Schillinger, LLP

(57) ABSTRACT

A laying head assembly for the formation of coils is disclosed and can include a laying head configured to rotate about an axis, a pathway defining an enclosed conduit configured to contain an elongated material, the pathway extending in a helical path around the laying head, and at least one support structure coupling the pathway to the laying head, wherein at least one of the one or more couplings have an asymmetrical cross-sectional shape.

18 Claims, 21 Drawing Sheets

COIL FORMING LAYING HEAD SYSTEM

CROSS-REFERENCE TO RELATED APPLICATION(S)

The present application claims priority under 35 U.S.C. § 119(e) to U.S. Provisional Patent Application No. 62/668,040, entitled "A COIL FORMING LAYING HEAD ASSEMBLY", filed on May 7, 2018, and naming as inventor Keith FIORUCCI, which is assigned to the current assignee hereof and is incorporated by reference herein in its entirety.

BACKGROUND

Field of the Disclosure

The following is directed to a coil-forming laying head system, and particularly, a laying head assembly with a pipe support and a particular pathway construction.

Description of the Related Art

In a typical rod rolling mill, as depicted diagrammatically in FIG. 1, billets are reheated in a furnace 10. The heated billets are extracted from the furnace and rolled through a roughing mill 12, an intermediate mill 14, and a finishing mill 16 followed in some cases by a post finishing block (not shown). The finished products are then directed to a laying head 18 (containing a laying head pipe) where they are formed into rings 20. The rings are deposited on a conveyor 22 for transport to a reforming station 24 where they are gathered into coils. While in transit on the conveyor, the rings can be subjected to controlled cooling designed to achieve selected metallurgical properties.

Over the last several decades, the delivery speeds of rod rolling mills have increased steadily. With the increased speed in delivery of the hot rolled product, the forces exerted on the laying head 18 and associated components increases. For example, the laying head 18 typically includes a pathway and/or split ring assembly attached to a terminal end of the laying head 18, which assists with the formation of the rings or coils of material. The wearing of the pathway and/or split ring can reduce the ability to deliver a stable ring pattern to the conveyor 22, which can affect the cooling and ultimately the end properties of the product. Replacement of the pathway and/or split-ring is a time consuming and costly issue for a mill.

The industry continues to demand improvements in laying heads and pathway designs to reduce mill downtime and reduce potentially hazardous conditions for workers.

BRIEF DESCRIPTION OF THE DRAWINGS

The present disclosure may be better understood, and its numerous features and advantages made apparent to those skilled in the art by referencing the accompanying drawings.

DETAILED DESCRIPTION

A laying head assembly can include a laying pathway defined by a laying head pipe that is support by a series of support assemblies extending outwardly from a central support structure on a laying head. Each of the support assemblies can include a support structure that is generally shaped like an air foil. As the laying head rotates at high speeds (RPMs), the shape of the support structures can substantially decrease the noise generated by the laying head assembly and can substantially decrease the power consumed by an electric motor coupled thereto. Further, the split ring of the laying head can include a plurality of enclosed segments and a plurality of open, single flanged segments, these segments can substantially reduce wear and tear on the split ring. Moreover, the limited number of support assemblies and segments substantially reduces maintenance time and the removal and replacement of a laying head pipe.

Figure 1:
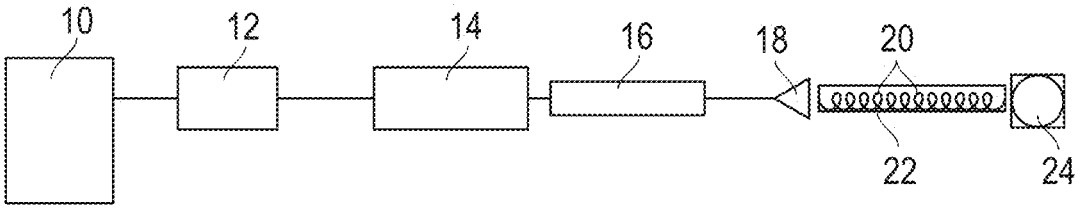
FIG. 1 (Prior Art)
FIG. 1 includes a diagram of a conventional rolling mill layout.
Figure 2:
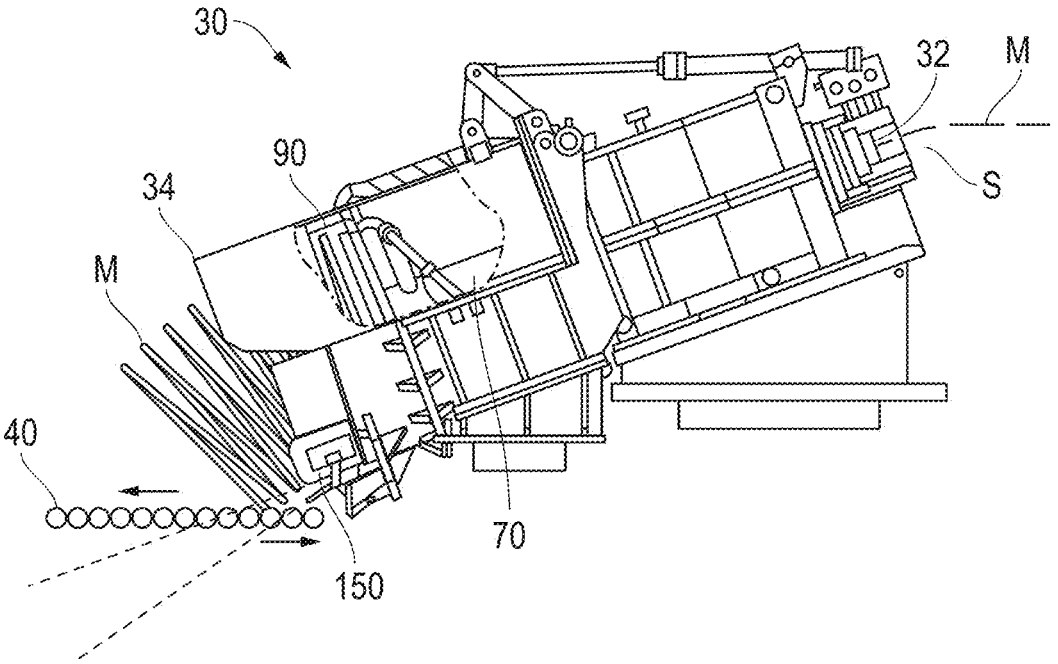
FIG. 2 includes a side view of a coil-forming laying head system in accordance with an exemplary embodiment.
Figure 3:
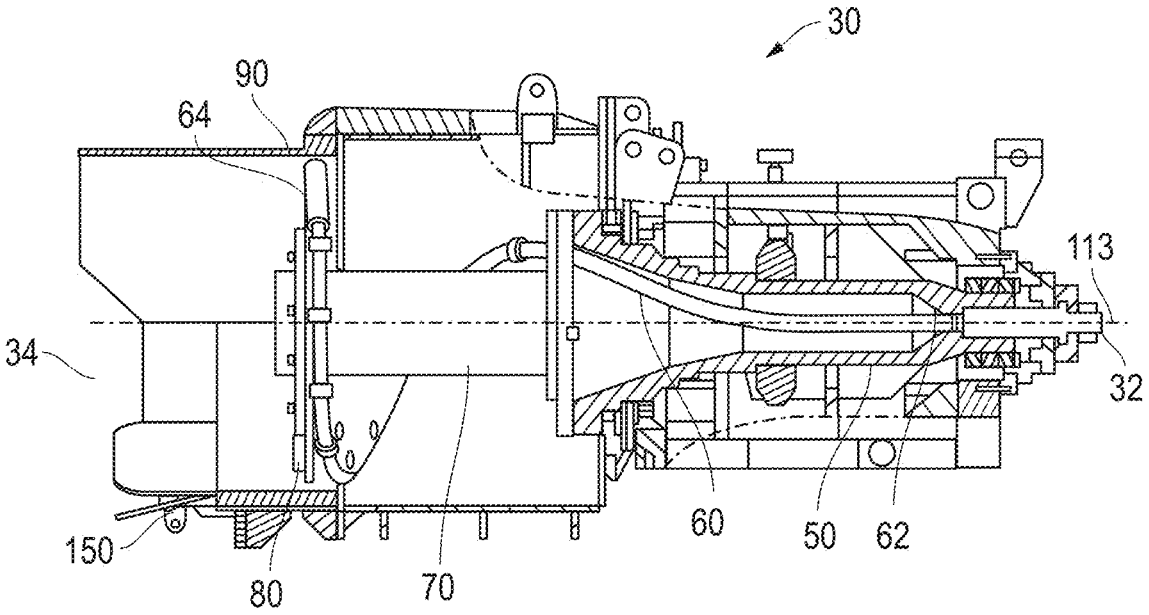
FIG. 3 includes a cross-section view of a coil-forming laying head system in accordance with an embodiment.

Referring initially to FIG. 2 and FIG. 3, a coil-forming laying head system 30 can be configured to coil elongated material, M, such as for example hot, rolled steel, rod or rebar, into a helical formation of rings. The elongated material can have a linear velocity or speed S, which may be as high as or greater than approximately 29,520 feet/min (150 m/sec), can be received in the coil-forming laying head system 30 intake end 32, and can be discharged in a series of continuous coil loops at the discharge end 34, whereupon the coils may be deposited on a conveyor 40. The elongated material, M, can be discharged from the coil-forming system 30 by gravity in a helical formation of rings on conveyor 40, aided by the downwardly angled quill rotational axis at the system discharge end 34. A tripper mechanism 150 can be configured to pivot about an axis abutting the distal axial side of the laying head shroud 90 guide surface. The pivotal axis can be tangential to the laying head shroud 90 inner diameter guide surface about a pivotal angle θ. The coiling characteristics of the elongated material, M, and the placement of the helical formation of rings on the conveyor 40 can be controlled by varying the pivotal angle θ.

The coil-forming laying head system 30 can have a quill 50 that can be configured to rotate about an axis 113. More particularly, the quill 50 can have a general horn-shaped contour or a bell-shaped contour that is adapted to rotate about the axis 113. The coil-forming laying head system 30 may also include a laying head pipe 60 and a laying head assembly 70, which may be coupled to the quill 50. The laying head pipe 60 and the laying head assembly 70 may be configured to rotate about the axis 113 with the quill 50 during operation. The laying head pipe 60 can be coupled to a laying head assembly 70 that is, in turn, coupled coaxially to the quill 50, so that all three components rotate synchronously about the quill 50 rotational axis 113. In certain embodiments, a supporting structure (not shown) may be included in the coil-forming laying head system 30 and may be configured to support the laying head assembly 70. The quill 50 rotational speed can be selected based upon, among other factors, the elongated material, M, structural dimensions and material properties, advancement speed S, desired coil diameter and number of tons of elongated material that can be processed by the laying head pipe without undue risk of excessive wear.

The laying head pipe 60 can define a hollow elongated cavity adapted to transport the elongated material, M, through its interior cavity. The laying head pipe 60 can have a generally helical axial profile of increasing radius, with a first end 62 that is aligned with the rotational axis of quill 50 and configured to receive the elongated material M, which may be a metal product, which can be formed into a helical formation of rings. As illustrated, the laying head pipe 60 can have a proximal portion extending along an axis, a terminal portion displaced radially and axially from the proximal portion, and an intermediate portion extending between the proximal portion and terminal portion in arcuate path. The first end 62 can be part of a proximal portion of the laying head pipe 60. The laying head pipe 60 can further include a second end 64 that can be part of a terminal portion of the laying head pipe 60 displaced radially and axially from the proximal portion. The second end 64 can be spaced radially outwardly from and generally tangential to the quill 50 rotational axis 113 and thus discharge the elongated material, M, generally tangentially to the periphery of the rotating quill 50.

In particular, the second end 64 (i.e., terminal end) of the laying head pipe 64 can terminate at, and be coupled to, an initial end of a pathway 80, and the pathway 80 can be coupled to an end of the laying head assembly 70. In particular, as illustrated in FIG. 4, while the laying head pipe 60 can extend from the first end 62 to the second end 64 of the coil-forming laying head system 30, the pathway 80 can be coupled to the terminal end of the laying head assembly 70 and extend axially in the direction of the axis 113 for a fraction of the full length of the laying head assembly 70.

The pathway 80 can be configured to control the tail end of the material, M, as it is exiting the laying head pipe 60 and define the final shape of the rings or coils of material, M, to be formed. As the elongated material, M, is advanced through the pathway 80 it may be conformed into a helical formation of rings. The pathway 80 can be coupled to the laying head assembly 70 and configured to rotate coaxially with the quill 50. The rotational speed of the quill 50 and the pathway 80 is substantially the same as the advancement speed, S, of the elongated material, M, such that there may be essentially no linear motion speed between the pathway 80 and the elongated material, M, which may facilitate less wear of the inner surfaces of the pathway 80 that contact the elongated material, M.

Figure 4:
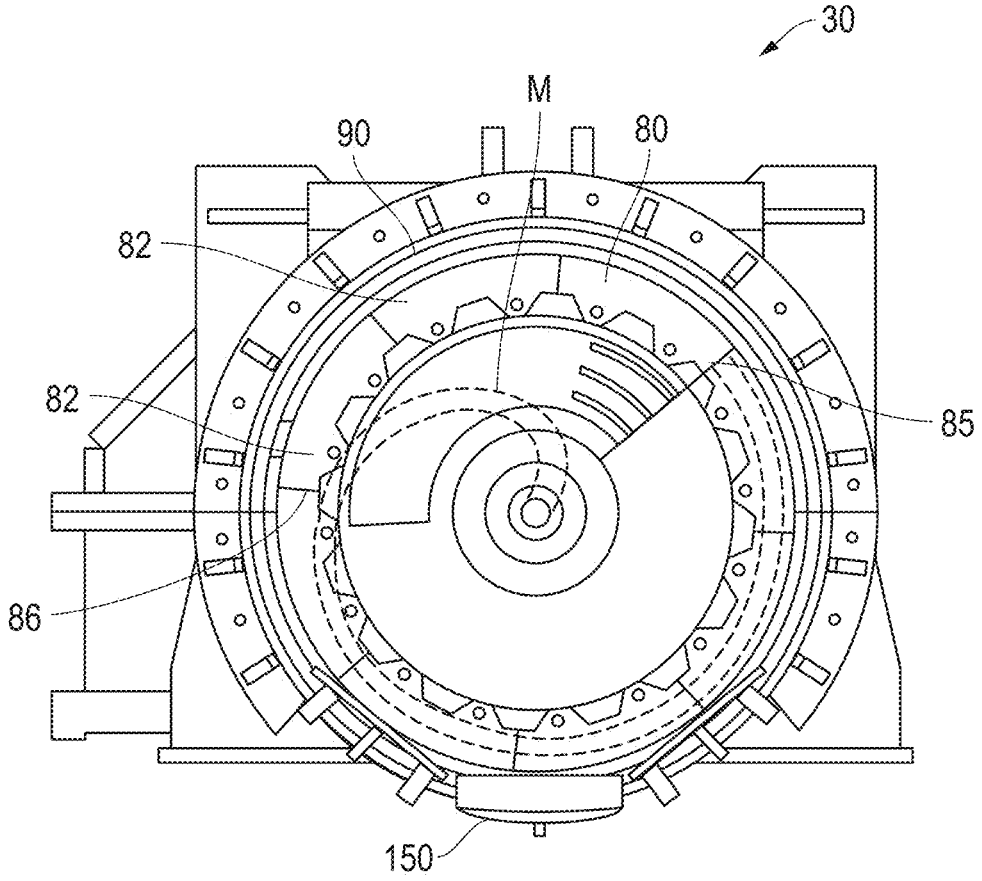
FIG. 4 includes a front view of a coil-forming laying head system in accordance with an embodiment.

In some embodiments and as shown in FIG. 2 through FIG. 4, the coil-forming laying head system 30 may include a laying head shroud 90, which may have an inner diameter that is coaxial with the quill 50 rotational axis 113 and circumscribes the second end 64 of the laying head pipe 60 and the pathway 80. Depending upon the structure of the pathway 80, the laying head shroud 90 may counteract a centrifugal force imparted on the elongated material, MAs it is discharged from the laying head pipe 60 by radially restraining the elongated material, M, within the inner diameter surface of the laying head shroud 90. In an embodiment, while the laying head pipe 60 and the laying head assembly 70 are configured to rotate about the axis 113, the laying head shroud 90 is stationary, such that it does not rotate about the axis 113. In a more particular embodiment, the coil-forming laying head system 30 may be formed such that it does not include a laying head shroud 90, but only a pathway 80 having a particular shape and construction that is sufficient to contain the elongated material, M, as it is discharged from the coil-forming laying head system 30 at the end of the pathway 80.

Figure 5:
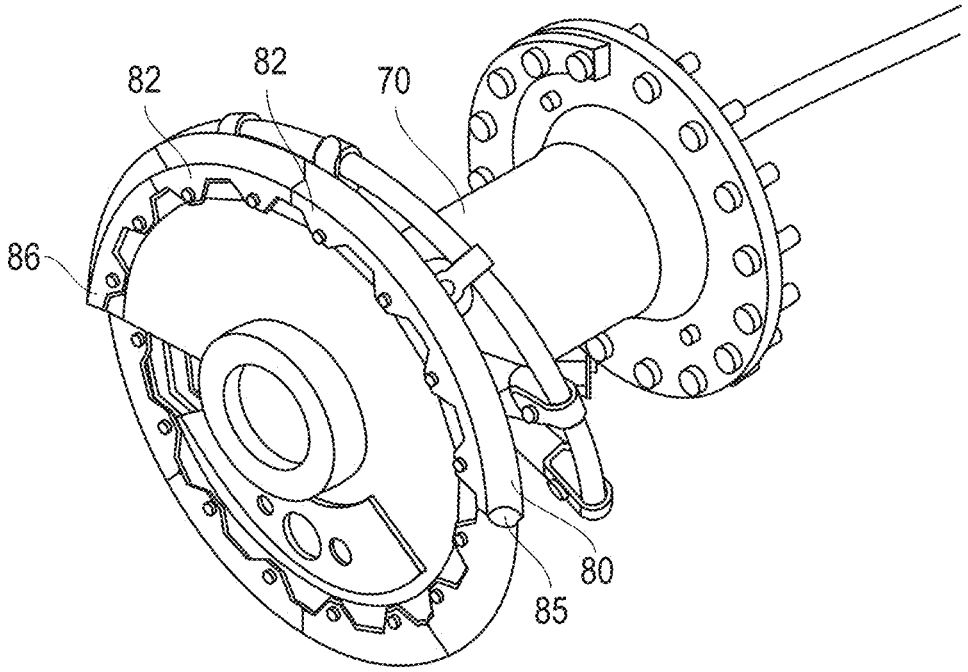
FIG. 5 includes a perspective view of a laying head in accordance with an embodiment.
Figure 6:
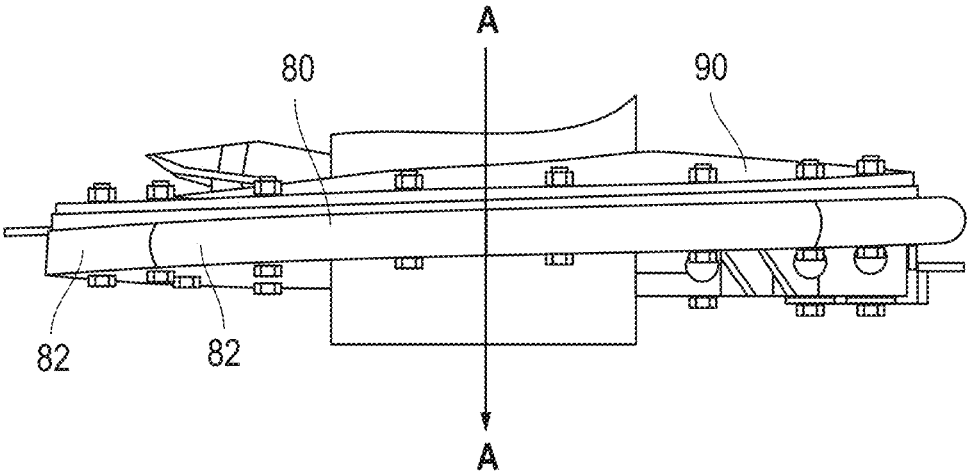
FIG. 6 includes a top plan view of a laying head in accordance with an embodiment.

FIG. 4 includes a front view of the coil-forming laying head system 30 in accordance with an embodiment. Notably, the coil-forming laying head system 30 can include a pathway 80 that can define a channel when viewed in cross-section. FIG. 5 and FIG. 6 include perspective and top plan views of the laying head assembly 70 and the pathway 80 in accordance with embodiments described herein. The pathway 80, in the form of a channel, can generally define a structure having at least one opening extending axially along the length of the pathway 80 from a proximal end 85 to a terminal end 86. For example, the pathway 80, being in the form or shape of a channel, can define an enclosed conduit, which includes at least one opening. In such embodiments, the opening of the pathway 80 may be oriented such that it is adjacent to the split ring 90, such that the combination of the pathway 80 (in the shape of a channel) and the split ring 90 define an enclosure configured to contain the elongated material, M, within said enclosure.

As further illustrated, the pathway 80 can be formed of a plurality of segments 82, which can be coupled to the terminal end of the laying head assembly 70. The plurality of segments 82 can be arranged circumferentially around a peripheral edge of the terminal end of the laying head assembly 70 to define the pathway 80. The plurality of segments 82 may be arranged end-to-end and disposed adjacent to each other to define the pathway 80. In certain instances, it may be feasible to allow for some spacing between two immediately adjacent segments 82 of the plurality of segments 82. It will be appreciated that such spacing may be controlled to maintain control of the elongated material, M, within the pathway 80. The plurality of segments 82 may be coupled to the laying head assembly 70 via fasteners or any other suitable mechanism.

Figure 7:
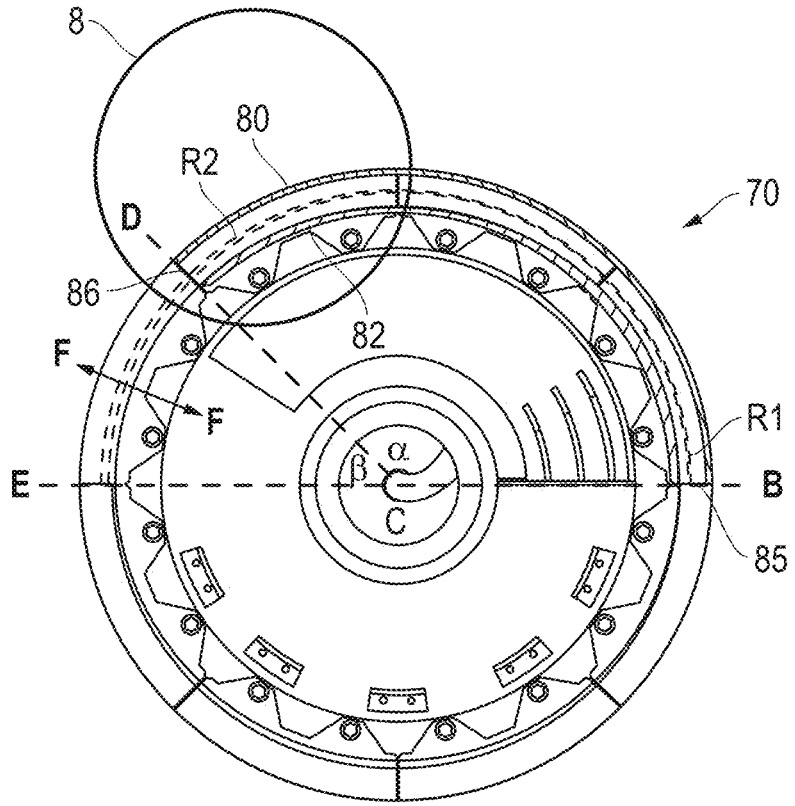
FIG. 7 includes a sectional front view of a laying head in accordance with an embodiment.

FIG. 7 includes a sectional front view of the laying head assembly 70 and the pathway 80 of FIG. 5 in accordance with an embodiment. Likewise, FIG. 8 includes detailed sectional front view of the laying head assembly 70 and the pathway 80, taken at circle 8 of FIG. 7, in accordance with an embodiment. The length or circumference through which the pathway 80 and each of the segments 82 of the plurality of segments 82 extends may be controlled to facilitate suitable operation of the system 30. For example, in at least one embodiment, the pathway 80 can extend around a periphery of the laying head assembly 70 through an angle, α, of less than 180°. The angle, α, can be defined as a central angle created by (1) a radius C-B that extends from a central point C to the proximal end 85 of the pathway 80; and (2) a radius C-D that extends from the central point C to the terminal end 86 of the pathway 80. In another embodiment, the pathway 80 can extend around the periphery of the laying head assembly 70 through an angle, α, of not greater than 179°, such as not greater than 178° or not greater than 177° or not greater than 176° or not greater than 175° or not greater than 174° or not greater than 173° or not greater than 172° or not greater than 171° or not greater than 170° or not greater than 165° or not greater than 160° or not greater than 150° or not greater than 140° or not greater than 130° or not greater than 120° or not greater than 115° or not greater than 110° or not greater than 100° or not greater than 95° or not greater than 90° or not greater than 85° or not greater than 80° or not greater than 75° or not greater than 70° or not greater than 65° or even not greater than 60°. In still another non-limiting embodiment, the pathway 80 can extend around the periphery of the laying head assembly 70 through an angle, α, of at least about 10°, such as at least about 20° or at least about 30° or at least about 40° or at least about 50° or at least about 60° or at least about 70° or at least about 80° or at least about 90° or at least about 100° or at least about 110° or at least about 120° or at least about 130° or at least about 140° or at least about 150° or even at least about 160°. It will be appreciated that the pathway 80 can extend around the periphery of the laying head assembly 70 through any angle, α, within a range including any of the minimum and maximum values noted above.

In another embodiment, each of the segments of the plurality of segments 82 can have a particular length relative to each other and a length that defines a portion of the entire length of the pathway 80. For example, in one embodiment, at least one of the segments 82 of the plurality of segments 82 can extend around the periphery of the laying head assembly 70 through an angle, β. The angle, β, can be defined as an angle created by (1) a radius C-D that extends from the central point C to a first point on the pathway 80; and (2) a radius C-E that extends from the central point C to a second point on the pathway 80. In another embodiment, at least one of the segments 82 of the plurality of segments 82 can extend around the periphery of the laying head assembly 70 through an angle, β, of at least about 5°, such as at least 10° or at least 15° or at least 20° or at least 25° or at least 30° or at least 35°. In still another non-limiting embodiment, at least one of the segments of the plurality of segments 82 can extend around the periphery of the laying head assembly 70 through an angle, β, of not greater than 175°, such as not greater than 160° or not greater than 150° or not greater than 140° or not greater than 120° or not greater than 100° or not greater than 90° or not greater than 80° or not greater than 70° or not greater than 60° or not greater than 55° or not greater than 40°. For example, a segment 82 of the plurality of segments 82 can extend around the periphery of the laying head assembly 70 through an angle, β, of at least about 15° and not greater than about 55°, such as an angle, β, of at least about 30° and not greater than about 40°. It will be appreciated that a segment 82 of the plurality of segments 82 can extend around the periphery of the laying head assembly 70 through any angle, β, within a range including any of the minimum and maximum values noted above.

According to one embodiment, each of the segments 82 of the plurality of segments 82 can have the same length or dimensions relative to each other, which can make them generally interchangeable and facilitate efficient maintenance. In yet another embodiment, any one of the segments 82 of the plurality of segments 82 can have a different length or dimension relative to each other. For example, it may be suitable that certain segments 82 that are exposed to greater wear are shorter or longer as compared to another segment 82 of the plurality of segments 82 to facilitate efficient maintenance.

Figure 8:
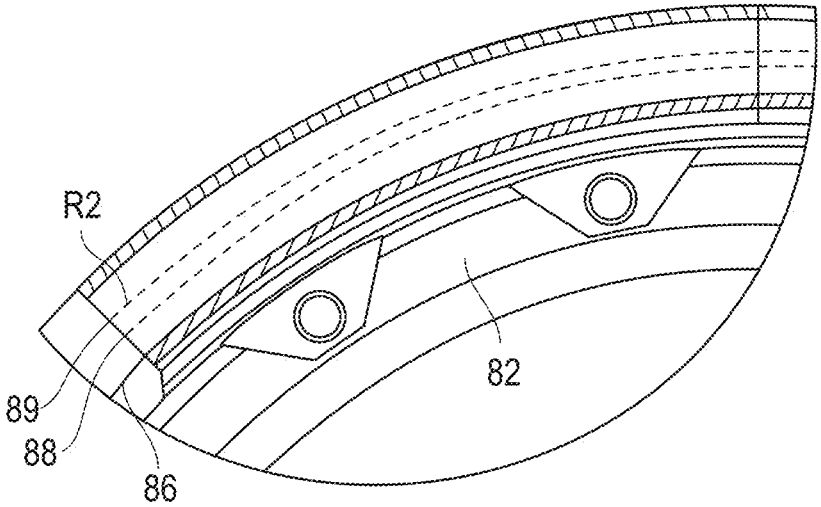
FIG. 8 includes an enlarged sectional front view of a laying head taken at circle 8 of FIG. 7 in accordance with an embodiment.

As further appreciated from the embodiments illustrated in FIG. 7 and FIG. 8, the pathway 80 can define a helical shape having a non-constant radius of curvature. For example, a proximal radius R1 of the pathway 80 at the proximal end 85 can differ compared to a terminal radius R2 of the pathway at the terminal end 86. The proximal radius R1 can be measured as the radial distance between a center point of the pathway 80 at the proximal end 85 and an inner surface of the pathway 80 at the proximal end 85. As shown in FIG. 8, the terminal radius R2 can likewise be measured as the radial distance between a center point 88 of the pathway 80 at the terminal end 86, which in some embodiments may be the same center point used to measure the proximal radius R1, and a point 89 on an inner surface of the pathway 80 at the terminal end 86. According to one embodiment, the proximal radius R1 can be less than the terminal radius R2, such that the pathway 80 extends around the periphery of the laying head assembly 70 and defines a helical shape having an increasing radius of curvature.

In another embodiment (not shown), the proximal radius R1 can be greater than the terminal radius R2, such that the pathway 80 extends around the periphery of the laying head assembly 70 and defines a helical shape having a decreasing radius of curvature. In a more particular embodiment, the difference in the radius of curvature can be defined as an absolute value of a difference in radius, as measured by the radius of curvature between an initial point (e.g., the proximal radius R1) on the pathway 80 and a terminal point (e.g., the terminal radius R2) on the pathway 80. In certain embodiments, the difference in radius can be at least 0.5%, such as at least 0.6% or at least 0.7% or at least 0.8% or at least 0.9% or at least 1% or at least 1.2% or at least 1.5% or at least 1.8% or at least 2% or at least 2.2% or at least 2.5% or at least 2.8% or at least 3% or at least 3.5% or at least 4% or at least 4.5% or at least 5% or at least 6% or at least 7% or at least 8% or at least 9% or at least 10%.

In another non-limiting embodiment, the difference in radius can be not greater than 50%, such as not greater than 40% or not greater than 30% or not greater than 20% or not greater than 18% or not greater than 15% or not greater than 13% or not greater than 10% or not greater than 9% or not greater than 8% or not greater than 7% or not greater than 6% or not greater than 5% or not greater than 4% or not greater than 3% or not greater than 2% or even not greater than 1%. It will be understood that the pathway 80 can have a difference in the radius of curvature within a range including any of the minimum and maximum percentages noted above. Changing the radius of curvature of the pathway 80 between the proximal end 85 and the terminal end 86, such as creating a pathway 80 having either an increasing or decreasing radius of curvature, has been noted to reduce the wear of the pathway 80 during operations.

Alternatively, the difference in radius of curvature of the pathway 80 can be expressed in terms of length (e.g., millimeters or mm). For example, the difference in the radius of curvature, defined as an absolute value of a difference in radius as measured by the radius of curvature between an initial point on the pathway (e.g., the proximal radius R1) and a terminal point on the pathway (e.g., the terminal radius R2) can be at least 2 mm, such as 3 mm or at least 5 mm or at least 10 mm or at least 20 mm or at least 50 mm or at least 100 mm or at least 150 mm or even at least 200 mm. In one non-limiting embodiments, the difference in the radius of curvature can be not greater than 500 mm, such as not greater than 400 mm or not greater than 300 mm or not greater than 200 mm or not greater than 100 mm or not greater than 80 mm or not greater than 60 mm or not greater than 40 mm or not greater than 20 mm or not greater than 10 mm. It will be understood that the pathway can have a difference in the radius of curvature within a range including any of the minimum and maximum values noted above, including for example, a difference of radius within a range of at least 5 mm and not greater than 10 mm.

Figure 9:
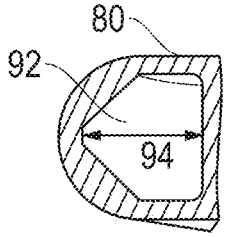
FIG. 9 includes a cross-sectional view of an enclosed conduit in accordance with an embodiment.
Figure 10:
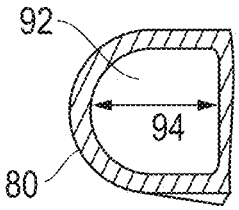
FIG. 10 includes a cross-sectional view of another enclosed conduit in accordance with an embodiment.

In an embodiment, the pathway 80, being in the form or shape of a channel, can define an enclosed conduit configured to contain the elongated material M. The enclosed conduit can extend axially along the entire length of the pathway 80 from the proximal end 85 to the terminal end 86 and also can extend circumferentially around at least a portion of the second end 64 of the laying head assembly 70. As illustrated in FIG. 4 through FIG. 8, the pathway 80 can define an enclosed conduit that is enclosed on all sides except at the proximal end 85 and at the terminal end 86. FIG. 9 and FIG. 10 include different cross-sectional views of an enclosed conduit in accordance with an embodiment. FIG. 9 and FIG. 10 are cross-sectional views taken from line A-A in FIG. 6.

In a particular aspect, the enclosed conduit 92 can include a suitable cross-sectional shape, such as ellipsoidal, circular, polygonal, irregular polygonal, or any combination thereof. For example, the pathway 80, and the enclosed conduit 92, can have a quadrilateral cross-sectional shape as viewed in a plane that is orthogonal to the length of the pathway 80 (e.g., along line A-A). In an embodiment, the enclosed conduit 92 includes a rectangular cross-sectional shape. In certain embodiments, the cross-sectional shape of the enclosed conduit 92 may be selected to reduce the wear of the pathway 80 during operations and/or improve the ability of the laying head system 30 to deliver a stable ring pattern to the conveyor 22. In such instances where the pathway 80 defines an enclosed conduit, a split ring 90 may not be necessary, as the pathway 80 and the enclosed conduit may be sufficient for fully containing the elongated material, M. Those embodiments utilizing a pathway 80 that defines an enclosed conduit can have any of the other features of the pathways described in the embodiments herein.

The enclosed conduit 92 can have a particular interior width 94 that may define the size of elongated material, M, that can pass therethrough. It will be appreciated that the interior width 94 can be an average value taken from multiple randomly placed measurements within the enclosed conduit 92. According to one embodiment, the enclosed conduit 92 can have an average interior width 94 of at least 4 mm, such as at least 5 mm or at least 6 mm or at least 7 mm or at least 8 mm or at least 9 mm or at least 10 mm or at least 15 mm or at least 20, Moor at least 25 mm. In one non-limiting embodiment, the average interior width 94 of the enclosed conduit 92 can be not greater than 50 mm, such as not greater than 40 mm or not greater than 30 mm or not greater than 20 mm or not greater than 10 mm or not greater than 8 mm. It will be appreciated that the enclosed conduit 92 can have an average interior width 94 within a range including any of the minimum and maximum values noted above.

In certain embodiments, the tail ends of the elongated material, M, can exit from the laying head pipe 60 through a pinch roll (not shown), enter the pathway 80 at the proximal end 85, traverse the pathway 80 by traveling through the enclosed conduit 92, and exit the pathway 80 at the terminal end 86. As the elongated material, M, exits the pathway 80 at the terminal end 86, a helix of rings of the elongated material, M, are laid down on the conveyor 22. Furthermore, as the elongated material, M, exits the pinch roll and enters the pathway 80, the pathway 80 can rotate away from, or backwards to, the direction of rotation of the elongated material, M. For example, if the elongated material, M, is rotating in a clockwise direction about the axis 113, or is exiting the laying head pipe 60 at the second end 64 such that a helix of rings 20 will be laid down on the conveyor 22 in a clockwise manner, the pathway 80 can rotate in a counterclockwise direction about the axis 113. The elongated material, M, may expand outwardly, in a radial direction, as it exits the pinch roll and enters the pathway 80. Because the pathway 80 is rotating away from the elongated material, M, however, a drag force can be exerted on the elongated material, M. The amount of the drag force exerted on the elongated material, M, can be adjusted by altering the internal profile (or cross-sectional shape) of the pathway 80 and/or the enclosed conduit 92. For example, the drag force on the elongated material, M, can be lessened if at least a portion of the cross-sectional shape of the pathway 80 and/or the enclosed conduit 92 is flattened. By contrast, the drag force on the elongated material, M, can be increased if at least a portion of the cross-sectional shape of the pathway and/or the enclosed conduit 92 has a "V" shape.

Figure 11:
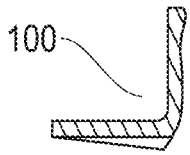
FIG. 11 includes a sectional view of an open trough in accordance with an embodiment.
Figure 12:
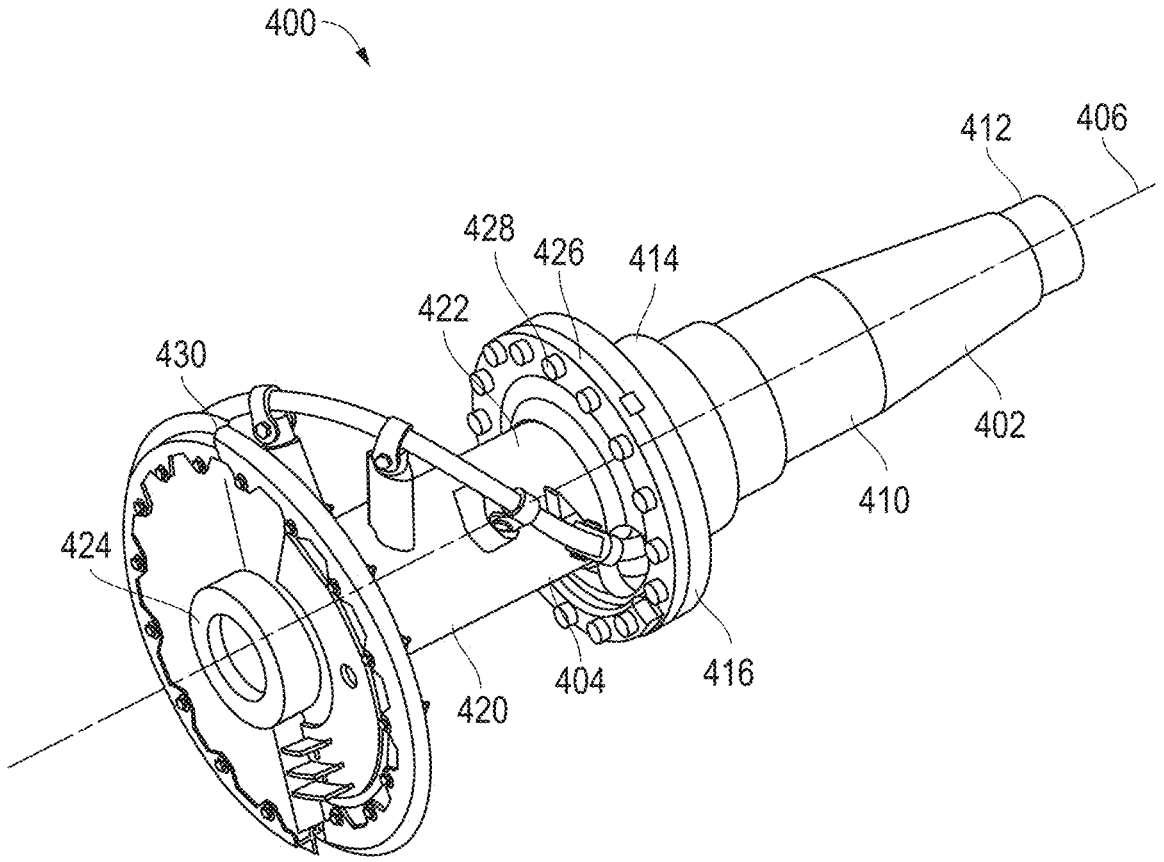
FIG. 12 includes a perspective view of a laying head assembly in accordance with an embodiment.
Figure 13:
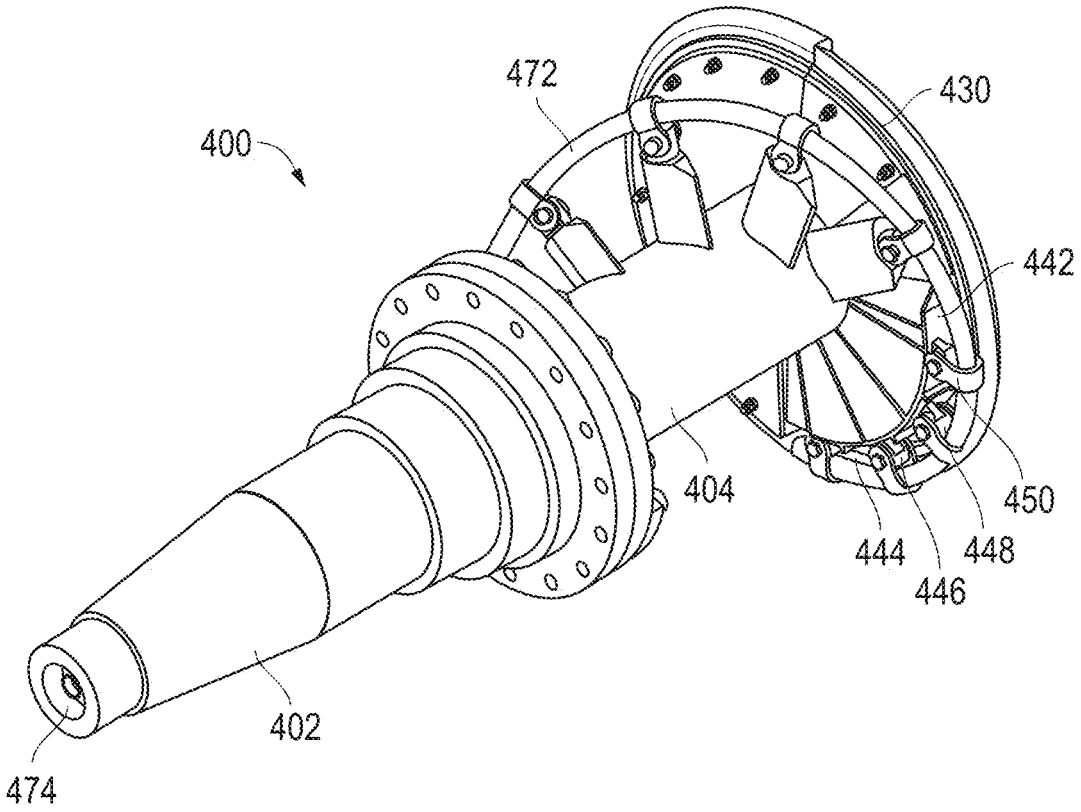
FIG. 13 includes another perspective view of a laying head assembly in accordance with an embodiment.
Figure 14:
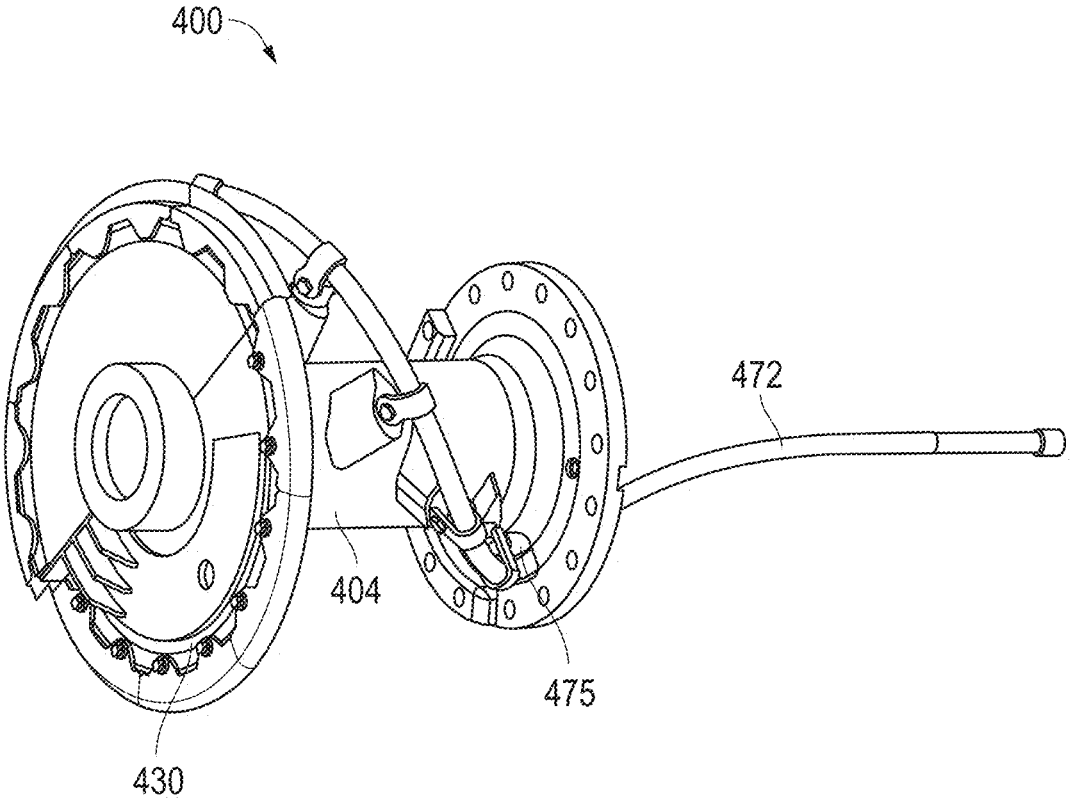
FIG. 14 includes still another perspective view of another laying head in accordance with an embodiment.

In certain embodiments, as the elongated material, M, exits the pathway 80 at the terminal end 86, the elongated material, M, may enter an open trough before being laid down as a helix of rings on the conveyor 22. FIG. 11 includes a sectional view of an open trough in accordance with an embodiment. The sectional view in FIG. 11 is taken along line F-F in FIG. 7. The open trough 100, also in the form of a channel, can generally define a structure having at least one opening and extending circumferentially around at least a portion of the second end 64 of the laying head assembly 70. For example, the open trough 100 can be oriented such that it begins adjacent to the terminal end 86 of the pathway 80 and it ends prior to the proximal end 85 of the pathway 80. The open trough 100 is open on at least 1 side and can define any suitable cross-sectional shape. In an embodiment, the open trough 100 is open on two sides and defines one substantially orthogonal angle. In such embodiments, the open trough 100 may be oriented such that it is adjacent to the pathway 80 and the split ring 90, such that the combination of the open trough 100, the pathway 80, and the split ring 90 define an enclosure configured to contain the elongated material, M, within said enclosure until the elongated material, Miss laid down as a helix of rings on the conveyor 22. For example, the elongated material, M, can exit the pathway 80 at the terminal end 86 and enter the open trough 100. As the elongated material, M, exits the open trough 100 at a point before the elongated material, M, would arrive back at the proximal end 85 of the pathway 80 again, a helix of rings of the elongated material, Mare laid down on the conveyor 22. Like the pathway 80, the open trough 100 may also rotate away from, or backwards to, the direction of rotation of the elongated material M. As with the pathway 80 and the enclosed conduit 92, the amount of the drag force exerted on the elongated material, M, also can be adjusted by altering the internal profile (or cross-sectional shape) of the open trough 100. Referring now to FIG. 12 and FIG. 13, another embodiment of a laying head assembly is shown and is generally designated 400. As illustrated, the laying head assembly 400 can include a quill 402 and a laying head 404 coupled thereto along a longitudinal axis 406 passing through the center of the laying head assembly 400. Specifically, the quill 402 can include a body 410 having a proximal end 412 and a distal end 414. The distal end 414 of the body 410 of the quill 402 can include a flange 416.

As depicted, the laying head 404 can include a central support structure 420 that can include a proximal end 422 and a distal end 424. The proximal end 422 of the central support structure 420 of the laying head 404 can include also include a flange 426. The flange 426 of the laying head 404 can abut the flange 416 of the quill 402 and a plurality of bolts 428 that can extend through bolt holes in each of the flanges 416, 426 can affix the flanges 416, 426 to each other. More importantly, the quill 402 can be affixed to the laying head 404. FIG. 12 and FIG. 13 also show that the laying head 404 can include a split ring 430 affixed to the distal end 424 of the central support structure 420 of the laying head 404. Details concerning the split ring 430 are discussed below.

Figure 15:
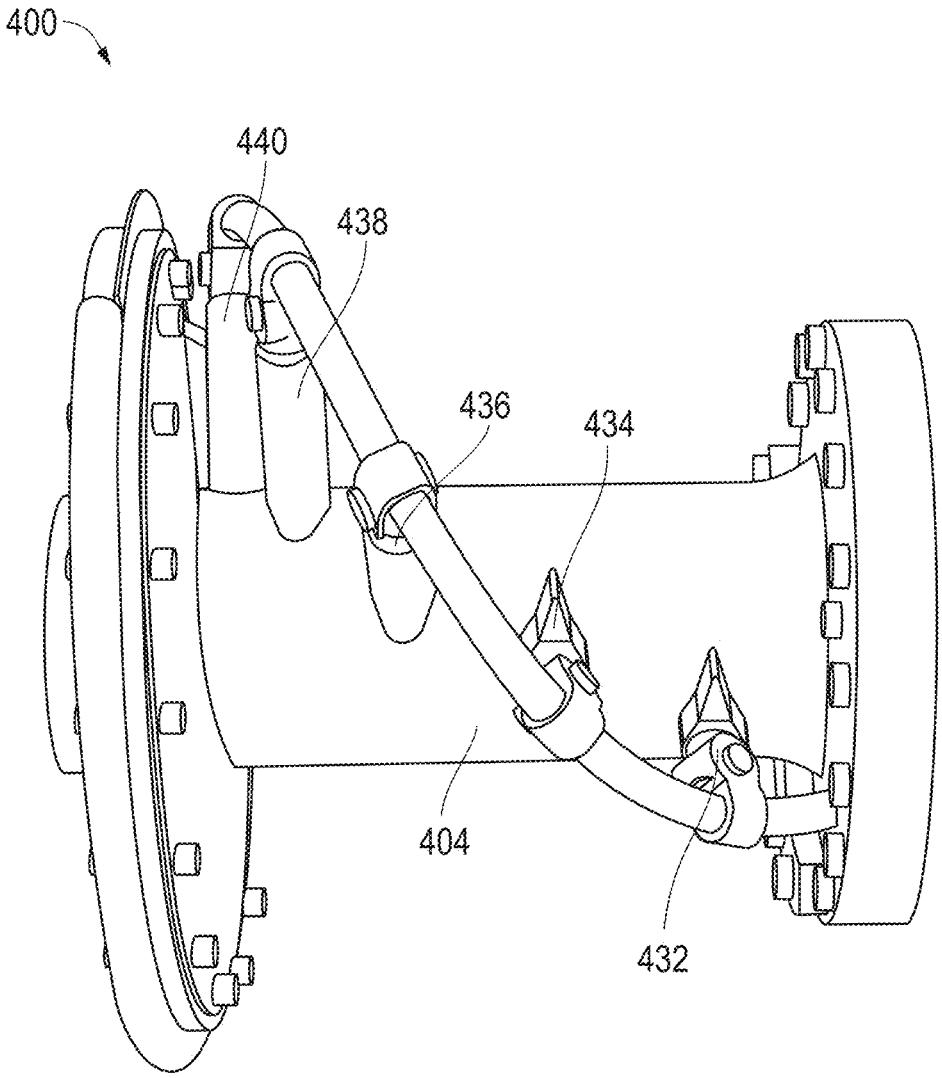
FIG. 15 includes a side plan view of a laying head in accordance with an embodiment.
Figure 16:
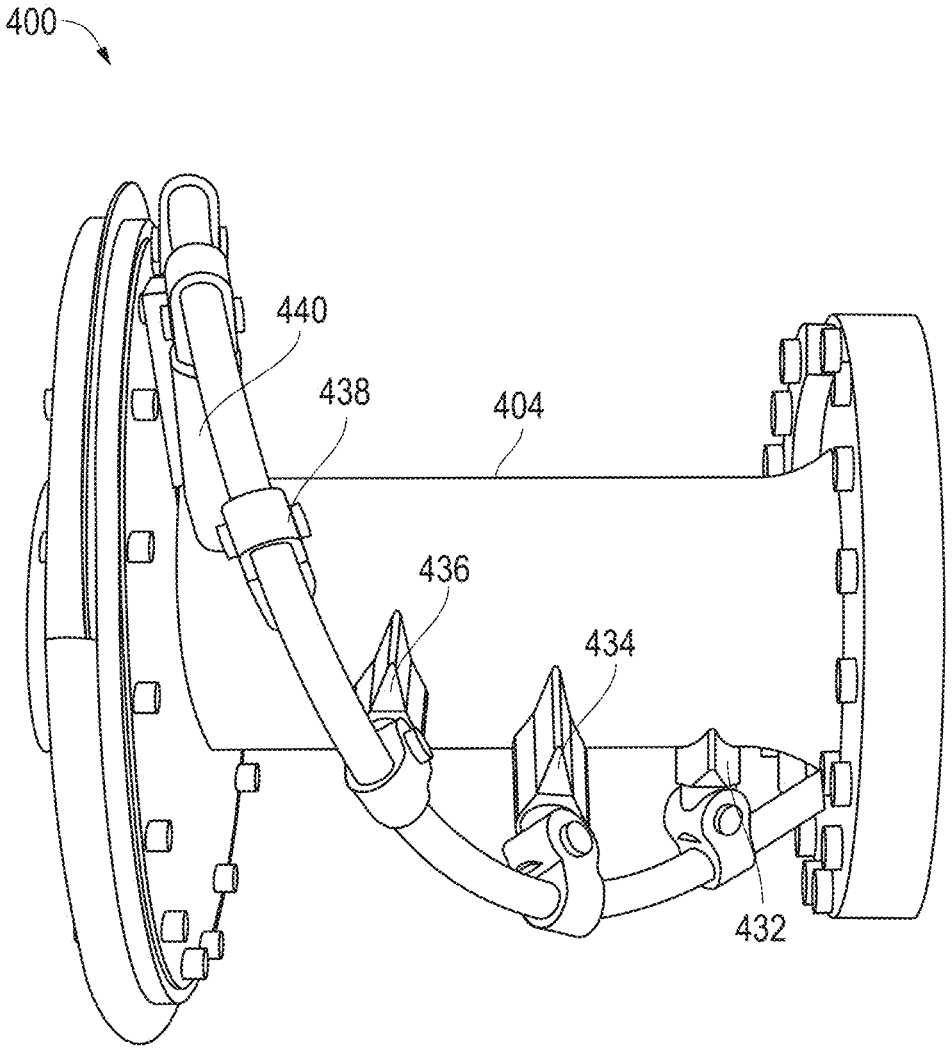
FIG. 16 includes a side plan view of a laying head in accordance with an embodiment.
Figure 17:
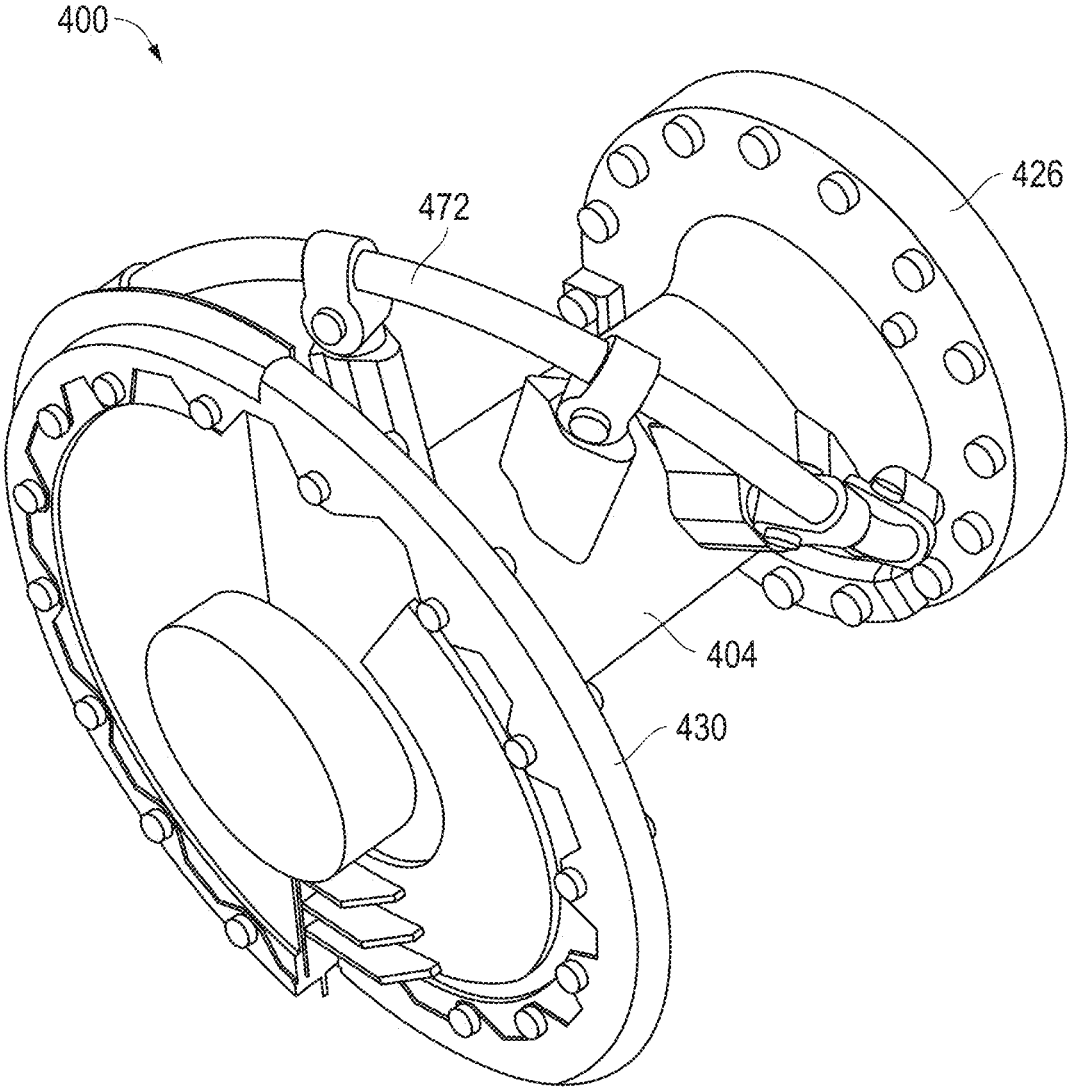
FIG. 17 includes a perspective view of a laying head in accordance with an embodiment.
Figure 18:
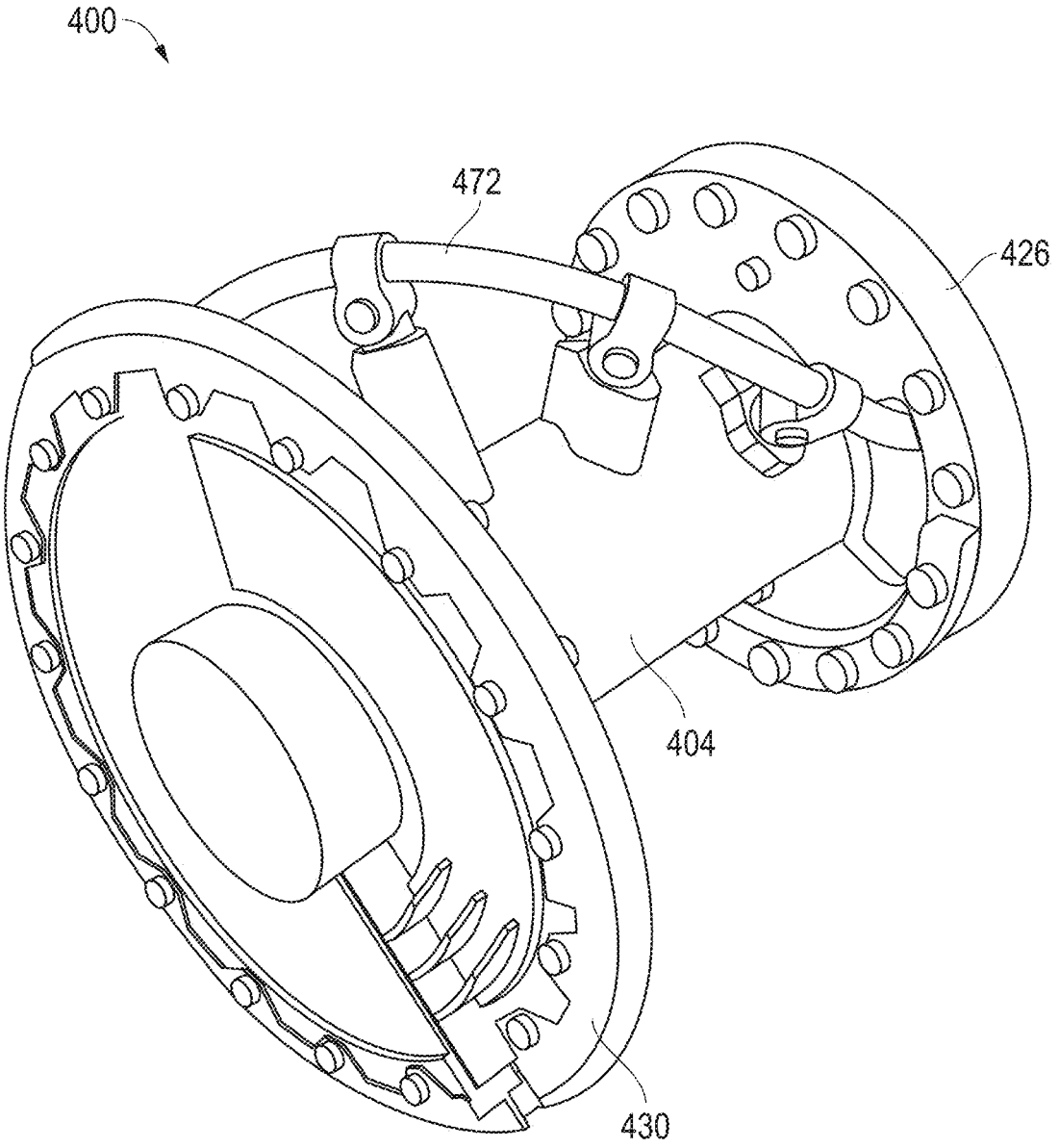
FIG. 18 includes another perspective view of a laying head in accordance with an embodiment.

As best shown in FIG. 15, starting closest to the flange 426 and moving along the central support structure 420 toward the split ring 430 the laying head 404 can include a first support assembly 432 that can extend outwardly from the outer periphery of the central support structure 420. The laying head 404 can include a second support assembly 434 that can extend outwardly from the outer periphery of the central support structure 420. Further, the laying head 404 can include a third support assembly 436 that can extend outwardly from the outer periphery of the central support structure 420. The laying head 404 can include a fourth support assembly 438 that can extend outwardly from the outer periphery of the central support structure 420. Further, the laying head 404 can include a fifth support assembly 440 that can extend outwardly from the outer periphery of the central support structure 420 adjacent to the split ring 430 on the laying head 404.

Returning to FIG. 13, the laying head 404 can also include a peripheral mounting plate 442 mounted near an outer periphery of the split ring 430. As shown, the peripheral mounting plate 442 can extend over an angle, $ANG_{PMP}$, and $ANG_{PMP}$ can be less than or equal to 110°. Moreover, $ANG_{PMP}$ can be less than or equal to 110°, such as less than or equal to 105°, less than or equal to 100°, less than or equal to 95°, or less than or equal to 90°. In another aspect, $ANG_{PMP}$ can be greater than or equal to 70°, such as greater than or equal to 75°, greater than or equal to 80°, or less than or equal to 85°. It is to be understood that $ANG_{PMP}$ can be within a range between, and including, any of the values of $ANG_{PMP}$ described herein.

FIG. 13 further shows that the laying head 404 can include a sixth support assembly 444 that can extend outwardly from the peripheral mounting plate 442 on the split ring 430 of the laying head 404. A seventh support assembly 446 can extend outwardly from the peripheral mounting plate 442 on the split ring 430 of the laying head 404. As shown, an eighth support assembly 448 can extend outwardly from the peripheral mounting plate 442 on the split ring 430 of the laying head 404. Further, a ninth support assembly 450 can extend outwardly from the peripheral mounting plate 442 on the split ring 430 of the laying head 404.

Figure 19:
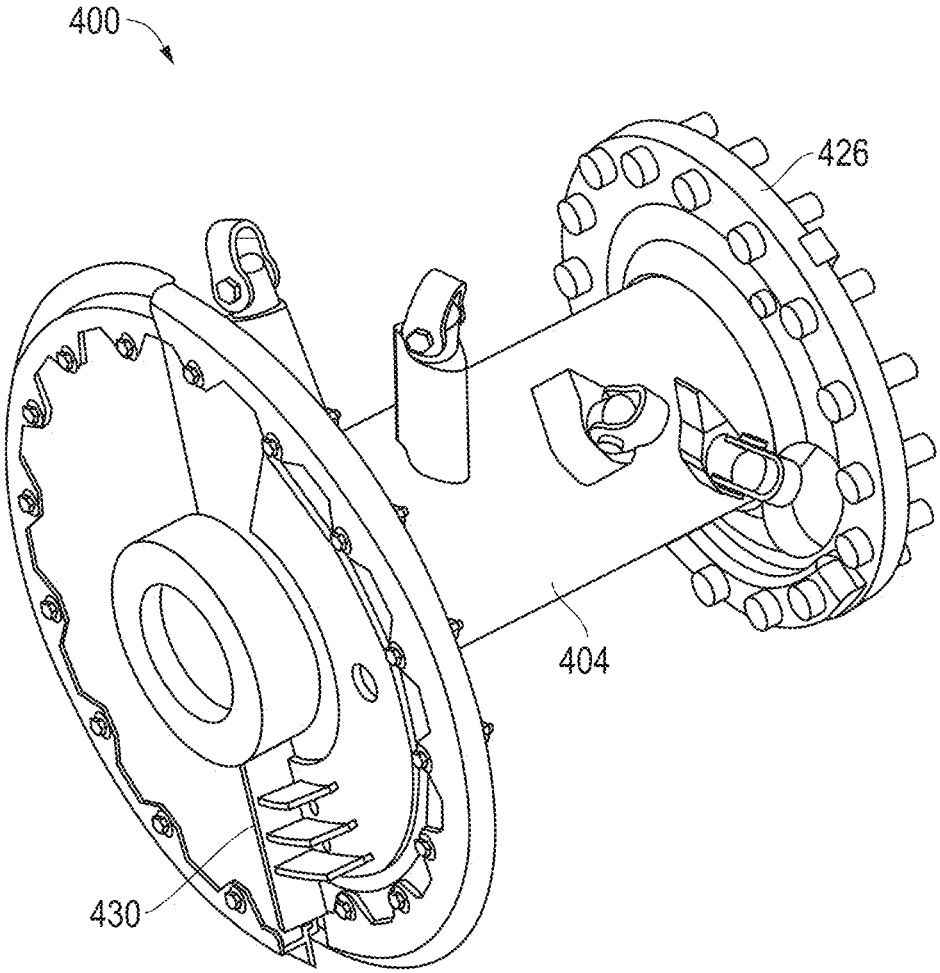
FIG. 19 includes a perspective view of a laying head without a laying head pipe in accordance with an embodiment.
Figure 20:
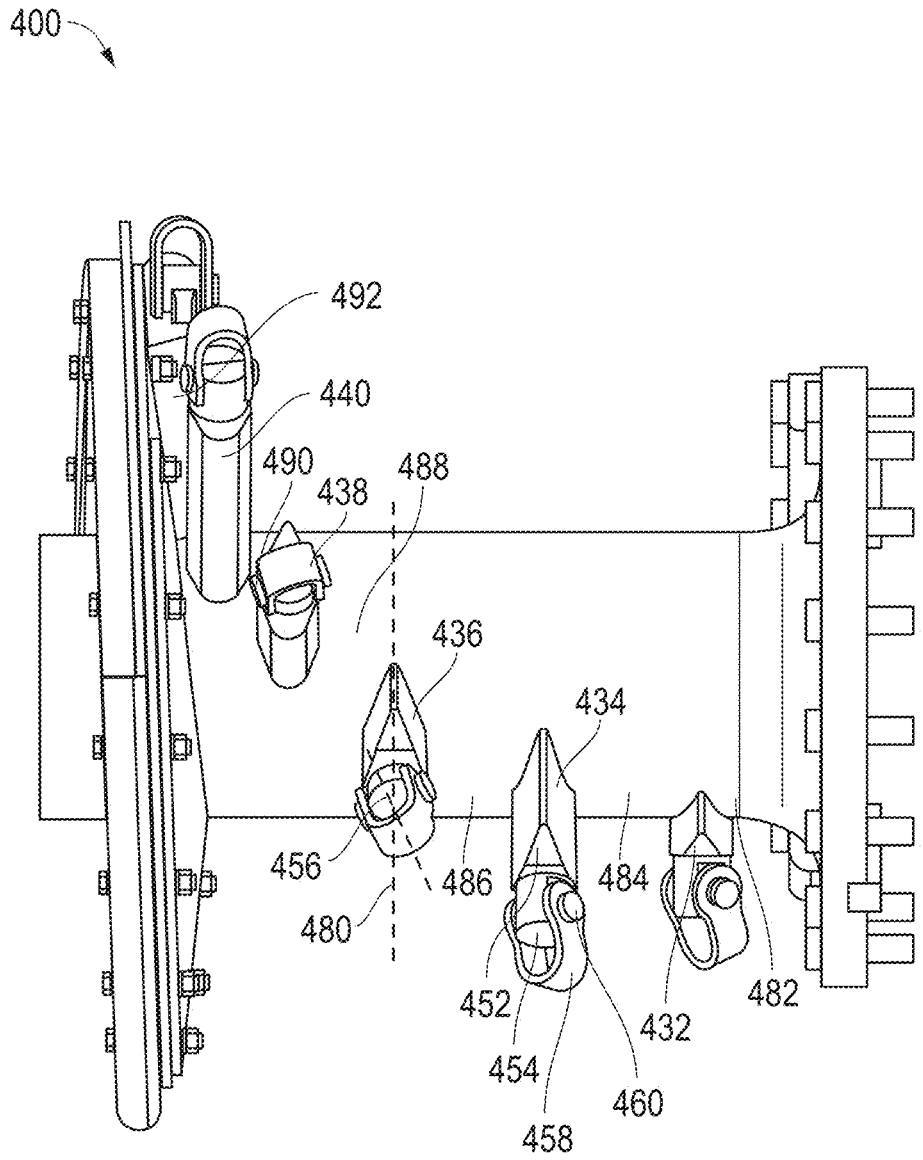
FIG. 20 includes a plan view of a laying head without a laying head pipe in accordance with an embodiment.
Figure 21:
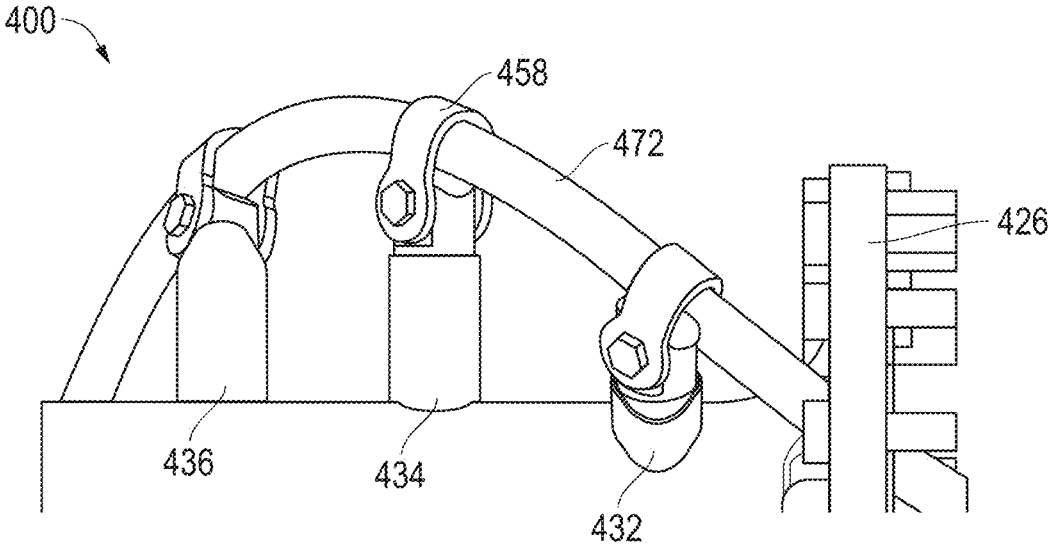
FIG. 21 includes a close-up view of a laying head in accordance with an embodiment.
Figure 22:
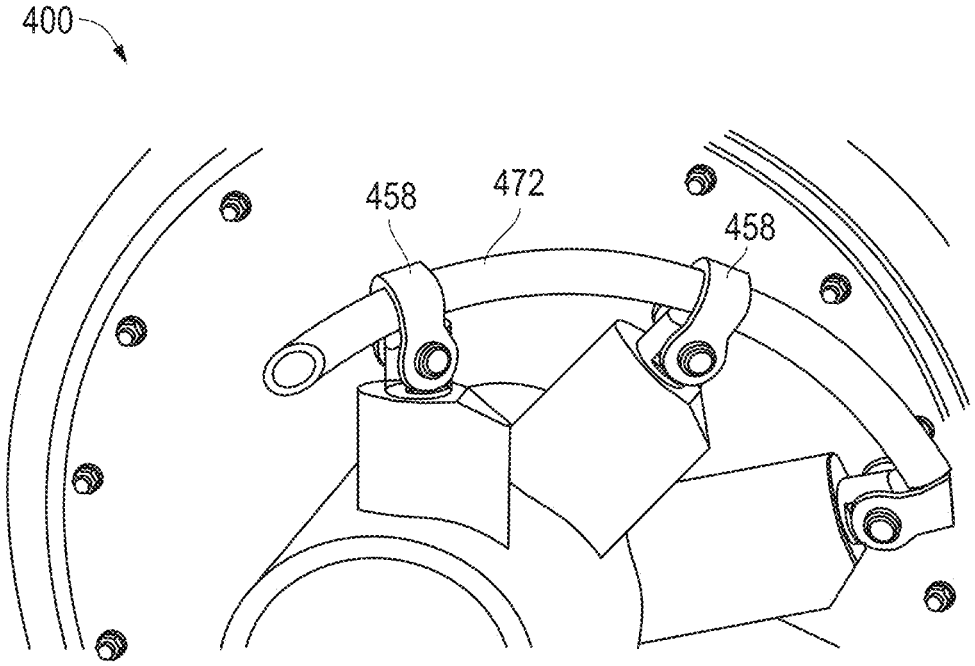
FIG. 22 includes another close-up of a laying head in accordance with an embodiment with portions cut away for clarity.

Referring now to FIG. 19 and FIG. 20, each of the first through fifth support assemblies 432, 434, 436, 438, 440 can include a support structure 452 that can extend radially outward from the central support structure 420 of the laying head 404. Further, each support structure 452 can be generally perpendicular to the longitudinal axis 406 of the laying head assembly 400. As illustrated in FIG. 19 and FIG. 20, each of the first through fifth support assemblies 432, 434, 436, 438, 440 can include a post 454 extending from the support structure 452. In a particular aspect, each post 454 is integrally formed with the support structure 452 so that the post 454 is static and does not rotate with respect to the support structure 452. However, each post 454 can be formed at an angle, $A_{post}$, with respect to the support structure 452, i.e., to a longitudinal axis 480 of the support structure, so that the center axis 456 of each post 454 follows the helical portion of the path of a laying head pathway, described below, that extends through and is supported by the support assemblies 432, 434, 436, 438, 440, 444, 446, 448, 450. In particular, the post angle, $A_{post}$, can be greater than or equal to 1°. Further, $A_{post}$ can be greater than or equal to 5°, such as greater than or equal to 10°, greater than or equal to 15°, greater than or equal to 20°, greater than or equal to 25°, greater than or equal to 30°, greater than or equal to 35°, greater than or equal to 40°, or greater than or equal to 45°. In another aspect, $A_{post}$ can be less than or equal to 89°, such as less than or equal to 85°, less than or equal to 80°, less than or equal to 75°, less than or equal to 70°, less than or equal to 65°, less than or equal to 60°, less than or equal to 55°, or less than or equal to 50°. It is to be understood that $A_{post}$ can be within a range between, and including, any of the values of $A_{post}$ described herein.

Moreover, it is to be understood that $A_{post}$ for each of the first through fifth support assemblies 432, 434, 436, 438, 440 can be different. Further, $A_{post}$ can get progressively smaller from the first support assembly 432 to the fifth support assembly 440. Conversely, $A_{post}$ can get progressively larger from the fifth support assembly 440 to the first support assembly 432.

Each post 454 of each of the first through fifth support assemblies 432, 434, 436, 438, 440 can be formed with a bore (not visible) therethrough. The bore of each post 454 can be substantially perpendicular to the center axis 456 of the post 454. FIG. 19 and FIG. 20 further indicate that each of the first through fifth support assemblies 432, 434, 436, 438, 440 can include a pipe clamp 458 mounted to the post 454 using a threaded fastener 460. Each pipe clamp 458 is generally U-shaped and can also be formed with a pair of bores (not visible) that can be aligned with the bore on each post 454. The threaded fastener 460 can extend through the bores on the post 454 and the pipe clamp 458 attached thereto. In a particular embodiment, each pipe clamp 458 can include a central axis 462 and the central axis 462 of each pipe clamp 458 can be coaxial with a laying head pipe, describe below, that extends through each pipe clamp 458.

Figure 30:
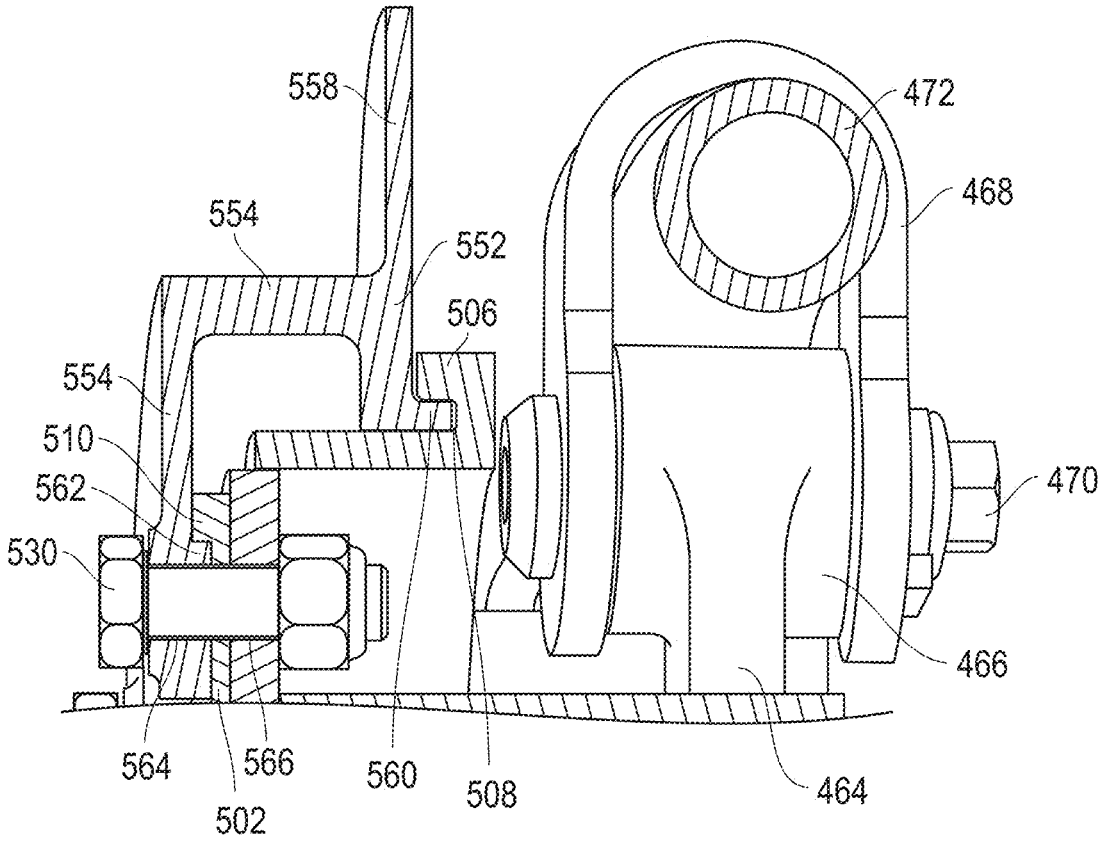
FIG. 30 includes a cross-section view of a laying head in accordance with an embodiment.

Referring now to FIG. 13 and FIG. 30, each of the sixth through ninth support assemblies 444, 446, 448, 450 is substantially identical and can include a support structure 464 that can extend outwardly from the peripheral mounting plate 442 of the split ring 430. In particular, each support structure 464 can extend substantially perpendicular to the longitudinal axis 406 of the laying head assembly 400. Further, each of the sixth through ninth support assemblies 444, 446, 448, 450 can further include a transverse collar 466 integrally formed with the support structure 464 of each of the sixth through ninth support assemblies 444, 446, 448, 450. Each transverse collar 466 is substantially perpendicular to the support structure 464 on which the transverse collar 466 is formed.

Each transverse collar 466 of each of the sixth through ninth support assemblies 444, 446, 448, 450 can be formed with a bore (not visible) therethrough. The bore of each transverse collar can be substantially parallel to the longitudinal axis 406 of the laying head assembly 400. FIG. 30 further shows that each of the sixth through ninth support assemblies 444, 446, 448, 450 can include a pipe clamp 468 mounted to the transverse collar 466 using a threaded fastener 470. Each pipe clamp 468 is generally U-shaped and can also be formed with a pair of bores (not visible) that can be aligned with the bore on each transverse collar 466. The threaded fastener 470 can extend through the bores on the transverse collar 466 and the pipe clamp 468 attached thereto. In a particular embodiment, each pipe clamp 468 can include a central axis extending through a center of the pipe clamp and the central axis of each pipe clamp 468 can be coaxial with a laying head pipe, describe below, that extends through each pipe clamp 468. Referring now to FIG. 12 through FIG. 15, the laying head assembly 400 can further include a laying head pipe 472 that can extend through an interior 474 of the quill 402, an opening 475 in the laying head 404 that can extend through the flange 426 on the proximal end 422 of the central support structure 420 of the laying head 404, through the pipe clamp 458 on the first support assembly 432, through the pipe clamp 458 on the second support assembly 434, through the pipe clamp 458 on the third support assembly 436, through the pipe clamp 458 on the fourth support assembly 438, through the pipe clamp 458 on the fifth support assembly 440, through the pipe clamp 468 on the sixth support assembly 444, through the pipe clamp 468 on the seventh support assembly 446, through the pipe clamp 468 on the eighth support assembly 448, and through the pipe clamp 468 on the ninth support assembly 450. The laying head pipe 472 can terminate at a plurality of segments, described in detail below, mounted around the outer periphery of the split ring 430 on the distal end 424 of the central support structure 420 of the laying head 404. It is to be understood that the laying head pipe 472 is an enclosed conduit that defines a laying pathway through the interior of the conduit. The laying head pipe 472 is configured to contain an elongated material as it moves therethrough.

The laying pathway within the laying head pipe 472 can include a proximal portion that can extend along an axis, a terminal portion displaced radially and axially from the proximal portion, and an intermediate portion that can extend between the proximal portion and terminal portion in arcuate path. Moreover, a mill line for forming metal can be coupled to a proximal end of the laying head pipe 472 and the laying pathway. In a particular aspect, the laying pathway within the laying head pipe is an elongated hollow pathway configured to receive metal product and form the metal product into a helical formation of rings. Further, in another aspect, the laying pathway can be a hollow body, e.g., the laying head pipe, comprising a metal or metal alloy. The laying head pipe 472 and the laying pathway are configured to rotate about the longitudinal axis 406 with the laying head 404.

The laying head pipe 472, and laying pathway defined therein, can extend in a tortuous, or helical, path around the central support structure 420 of the laying head 404. Moreover, the first through fifth support assemblies 432, 434, 436, 438, 440 can extend from the laying head 404 along a tortuous, or helical, path around the central support structure 420 of the laying head 404. It can be appreciated that the each of the first through fifth support assemblies 432, 434, 436, 438, 440 is attached to the laying head 404 at a proximal end of the support assembly 432, 434, 436, 438, 440 and attached to the laying head pipe 472, and the laying pathway defined therein, at a terminal end of the support assembly 432, 434, 436, 438, 440 opposite the proximal end of the support assembly 432, 434, 436, 438, 440. It can also be appreciated that each of the support assemblies 432, 434, 436, 438, 440, or the support structures 452 of each of the support assemblies 432, 434, 436, 438, 440, can have a different height.

Further, the support assemblies 432, 434, 436, 438, 440, or the support structures 452 of each of the support assemblies 432, 434, 436, 438, 440, can get progressively taller from the first support assembly 432 to the fifth support assembly 440 as measured from the outer surface of the central support structure 420 of the laying head 404 to the top of the support assembly 432, 434, 436, 438, 440. In other words, the second support assembly 434 is taller than the first support assembly 432; the third support assembly 436 is taller than the second support assembly 434 and the first support assembly 432; the fourth support assembly 438 is taller than the third support assembly 436, the second support assembly 434, and the first support assembly 432; and the fifth support assembly 440 is taller than the fourth support assembly 438, the third support assembly 436, the second support assembly 434, and the first support assembly 432.

Conversely, the support assemblies 432, 434, 436, 438, 440, or the support structures 452 of each of the support assemblies 432, 434, 436, 438, 440, can get progressively shorter from the fifth support assembly 440 to the first support assembly 432 as measured from the outer surface of the central support structure 420 of the laying head 404 to the top of the support assembly 432, 434, 436, 438, 440. In other words, the fourth support assembly 438 is shorter than the fifth support assembly 440; the third support assembly 436 is shorter than the fourth support assembly 438 and the fifth support assembly 440; the second support assembly 434 is shorter than the third support assembly 436, the fourth support assembly 438, and the fifth support assembly 440;

and the first support assembly 432 is shorter than the second support assembly 434, the third support assembly 436, the fourth support assembly 438, and the fifth support assembly 440.

Figure 25:
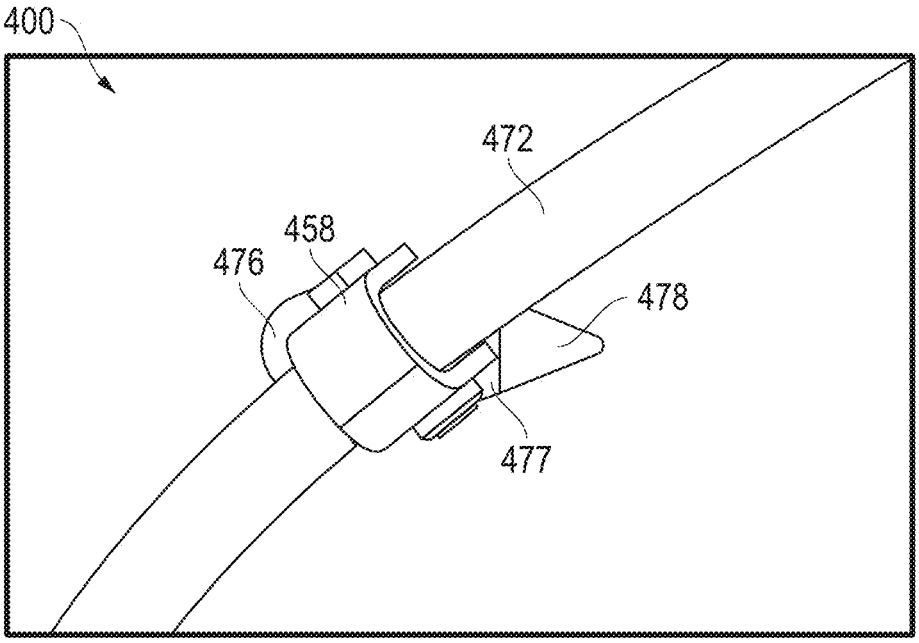
FIG. 25 includes another close-up of a laying head in accordance with an embodiment.
Figure 26:
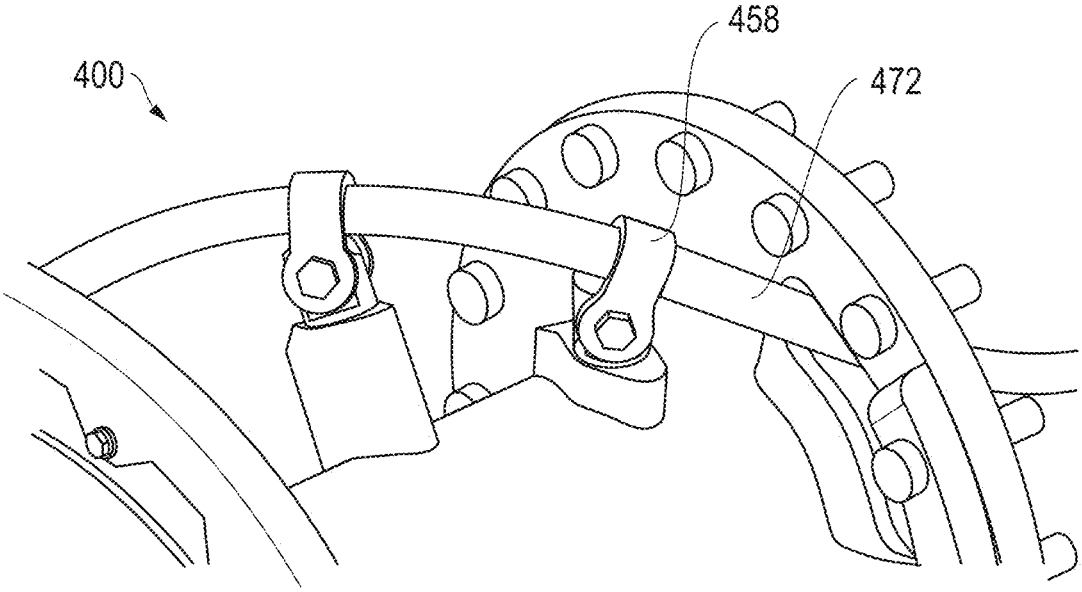
FIG. 26 includes yet another close-up of a laying head in accordance with an embodiment.
Figure 31:
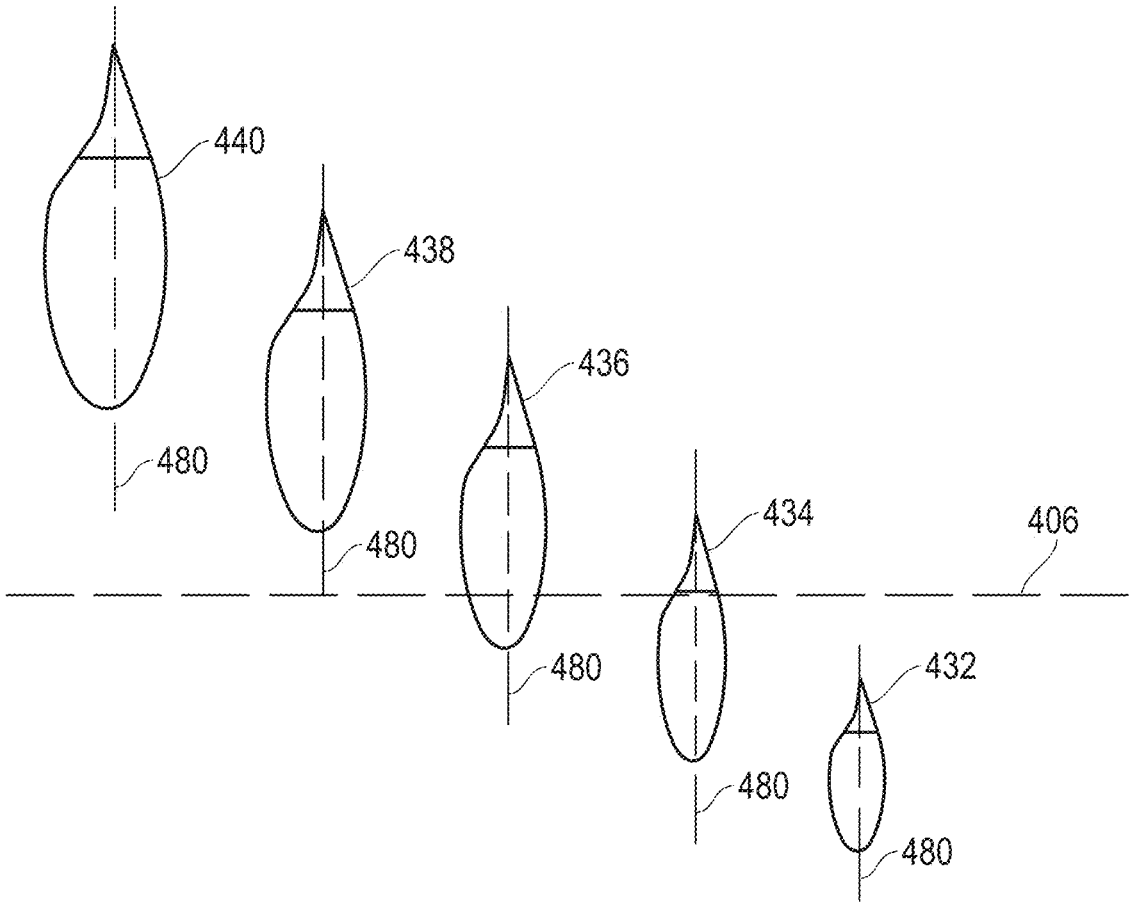
FIG. 31 includes an exploded cross-sectional top view of a plurality of support structures of a laying head in accordance with an embodiment.

In a particular aspect, as shown in FIG. 25, the support structure 452 of each of the first through fifth support assemblies 432, 434, 436, 438, 440 can be generally tear dropped shaped or generally shaped like an airfoil (in a top plan view). Each support structure 452 can have a rounded leading end 476 extending from a central region 477 and an elongated trailing end 478 extending from the central region 477 in a lateral direction, relative to the longitudinal axis 406 of the laying head assembly. The trailing end 478 can extend in a direction opposite an intended direction of rotating of the laying head assembly 400, the laying head 404, and the laying pathway formed within the laying head pipe 472. As shown, the trailing end 478 of each support structure 452 can extend for a majority of a total length of the support structure 452. In a particular aspect, the trailing end 478 of each support structure 452 can have the same contour, or shape. In another aspect, the trailing end of each support structure 452 have a different contour, or shape. In another aspect, each support structure 452 can have the same cross-sectional shape. Moreover, as shown in FIG. 31, each support structure 452 can have a different cross-sectional shape.

As shown in FIG. 20, each support structure 452 can be oriented so that a longitudinal axis 480 of each support structure 452 is perpendicular to the longitudinal axis 406 of the laying head assembly 400 about which the laying head assembly 400 can rotate. Additionally, as shown in FIG. 25, each support structure 452 is oriented so that the leading end 476 moves through the air before the trailing end 478 as the laying head assembly 400 rotates. It is to be understood that the airfoil shape of the support structure 452 can be a symmetrical airfoil shape or a cambered airfoil shape. In other words, the cross-sectional shape of the support structure 452 can be symmetrical about the longitudinal axis 480. Conversely, the cross-sectional shape of the support structure 452 can be asymmetrical about the longitudinal axis 480. Further, the cross-sectional shape of the support structure 452 can be asymmetrical about a lateral axis that is perpendicular to the longitudinal axis 480.

The shape and arrangement of the support structures 450 can substantially minimize the noise generated by the laying head assembly 400 during operation of the laying head assembly 400. This noise reduction can result in a more friendly work environment. Further, the shape and arrangement of the support structures 450 can substantially minimize power consumption of a motor coupled to the laying head assembly 400 during operation. The reduction in power creates more energy savings for mill operators.

Figure 23:
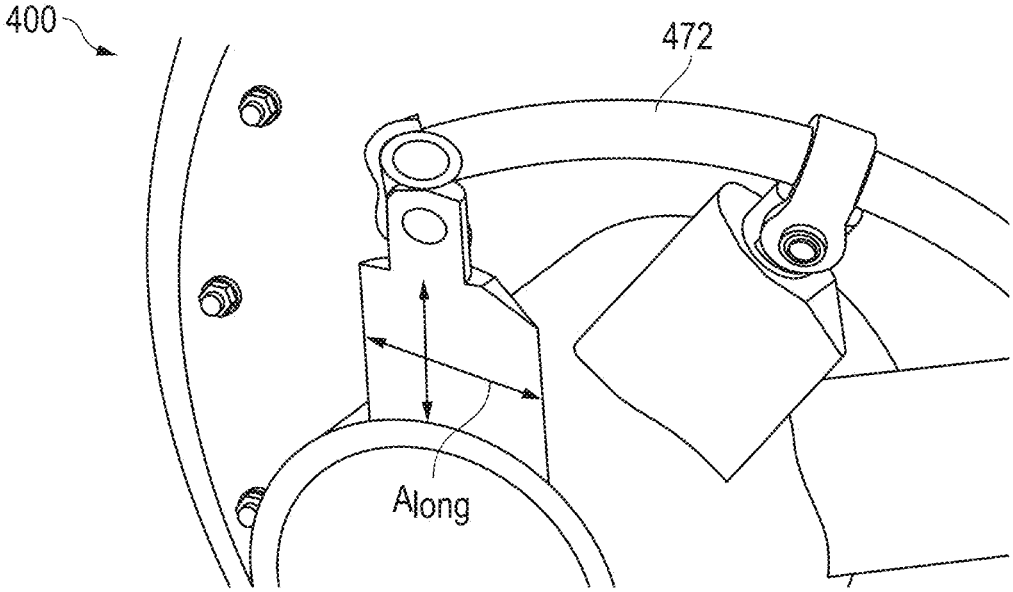
FIG. 23 includes another close-up of a laying head in accordance with an embodiment with portions cut away for clarity.
Figure 24:
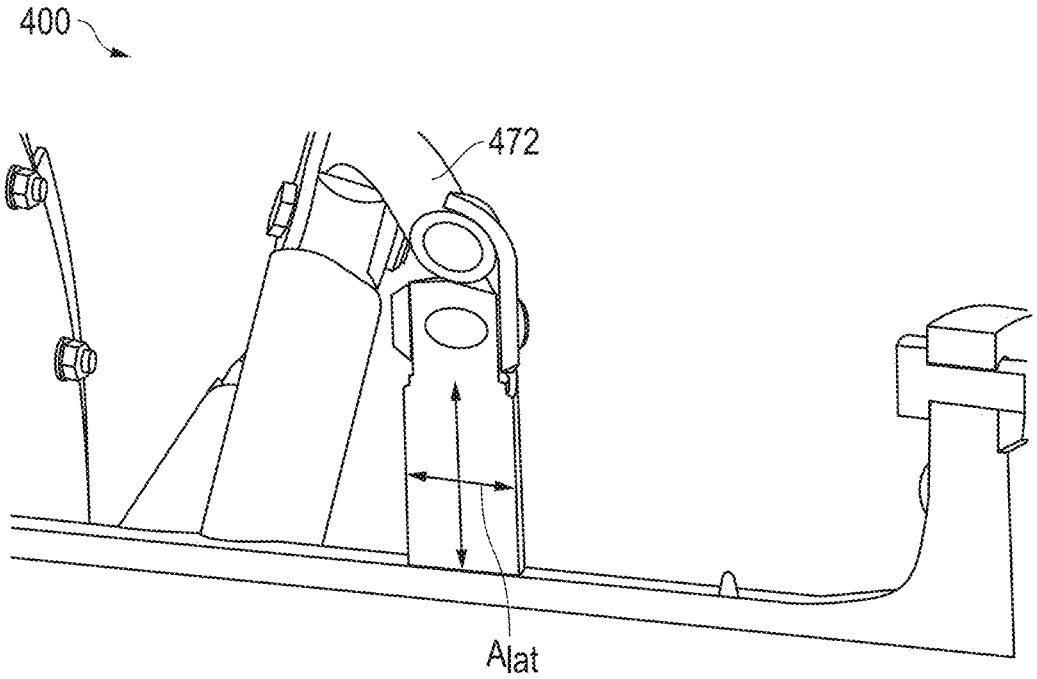
FIG. 24 includes another close-up of a laying head in accordance with an embodiment with portions cut away for clarity.

FIG. 23 indicates that each support structure 452 can have an overall longitudinal profile area, $A_{long}$, measured through the longest part of the support structure 452 and not including the post 454. Further, each support structure 454 can have an overall lateral profile area, $A_{lat}$, measure through the widest part of the support structure 452 and not including the post 454. In a particular aspect, a ratio, $A_{lat}/A_{long}$, may not be greater than 0.99 or not greater than 0.98 or not greater than 0.97 or not greater than 0.95 or not greater than 0.93 or not greater than 0.9 or not greater than 0.85 or not greater than 0.8 or not greater than 0.75 or not greater than 0.7 or not greater than 0.65 or not greater than 0.6 or not greater than 0.55 or not greater than 0.5 or not greater than 0.45 or not greater than 0.4 or not greater than 0.35 or not greater than 0.3 or not greater than 0.25 or not greater than 0.2 or not greater than 0.15 or not greater than 0.1 or not greater than 0.05. In another aspect, the ratio, $A_{lat}/A_{long}$, may be at least 0.01 or at least 0.03 or at least 0.05 or at least 0.08 or at least 0.1 or at least 0.15 or at least 0.2 or at least 0.25 or at least 0.3 or at least 0.35 or at least 0.4 or at last 0.45 or at least 0.5 or at least 0.55 or at least 0.6 or at least 0.65 or at least 0.7 or at least 0.75 or at least 0.8 or at last 0.85 or at least 0.9. It is to be understood that the ratio, $A_{lat}/A_{long}$, can be within a range between and including any of the maximum and minimum values for the ratio, $A_{lat}/A_{long}$, described herein.

Referring now to FIG. 20, the laying head assembly 400 can include a plurality of voids extending between, or within, the plurality of the first through fifth support assemblies 432, 434, 436, 438, 440. Specifically, the laying head assembly 400 can include a first void 482 between the flange 426 on the proximal end 422 of the support structure 420 of the laying head 404 and the first support assembly 432. Further, the laying head assembly 400 can include a second void 484 between the first support assembly 432 and the second support assembly 434. The laying head assembly 400 can also include a third void 486 between the second support assembly 434 and the third support assembly 436. The laying head assembly 400 can include a fourth void 488 between the third support assembly 436 and the fourth support assembly 438. Moreover, the laying head assembly 400 can include a fifth void 490 between the fourth support assembly 438 and the fifth support assembly 440. As illustrated, the laying head assembly 400 can also include a sixth void 492 between the fifth support assembly 440 and the split ring 430 affixed to the distal end 424 of the central support structure 420 of the laying head 404.

In a particular aspect, at least one of the voids 482, 484, 486, 488, 490, 492, or each of the voids 482, 484, 486, 488, 490, 492, can define at least 5% of a total area between the laying head 404 and the pathway. Further, the at least one void 482, 484, 486, 488, 490, 492, or each of the voids 482, 484, 486, 488, 490, 492, can define at least 10% of the total area or at least 20% or at least 30% or at least 40% or at least 50% or at least 60% or at least 70% or at least 80% or at least 90%. In another aspect, the at least one void 482, 484, 486, 488, 490, 492, or each of the voids 482, 484, 486, 488, 490, 492, can define not greater than 99% of the total area or not greater than 95% or not greater than 90% or not greater than 80% or not greater than 70% or not greater than 60% or not greater than 50%. It can be appreciated that the void % may be within a range between, and including, any of the maximum and minimum void % values described herein.

It can be appreciated that the at least one void 482, 484, 486, 488, 490, 492, or each of the voids 482, 484, 486, 488, 490, 492, can be bounded by the laying head 404, the central support structure 420 of the laying head 404, the laying head pathway, the laying head pipe 472, one or more of the first through fifth supports 432, 434, 436, 438, 440, the flange 426 on the laying head 404, the split ring 430 on the laying head 404, or a combination thereof. Moreover, the plurality of voids 482, 484, 486, 488, 490 can extend along a tortuous path of the laying head pathway.

It is well understood in the roll mill industry that laying head pipes 472 wear out periodically and require changing. It can be appreciated that the limited number of support assemblies 432, 434, 436, 438, 440, 444, 446, 448, 450, and clamps 458, described herein, can allow the laying head pipe 472 to be changed much more quickly and easily than in a traditional laying head assembly that typically has a minimum of 14 clamps. The present configuration of support assemblies 432, 434, 436, 438, 440, 444, 446, 448, 450, and clamps 458, reduces the number of clamping points on the laying head pipe 472 without reducing integrity of the laying head assembly 400, functionality of the laying head assembly 400, or durability of the laying head assembly 400. The reduction in clamping points on the laying head pipe 472 can save a typical mill operator around 15 minutes to fully replace the laying head pipe 472. On average, this is a 36% reduction in the time required to remove and replace the laying head pipe 472. This reduction in time reduces the down time of the roll mill and increases the production of the roll mill.

Figure 27:
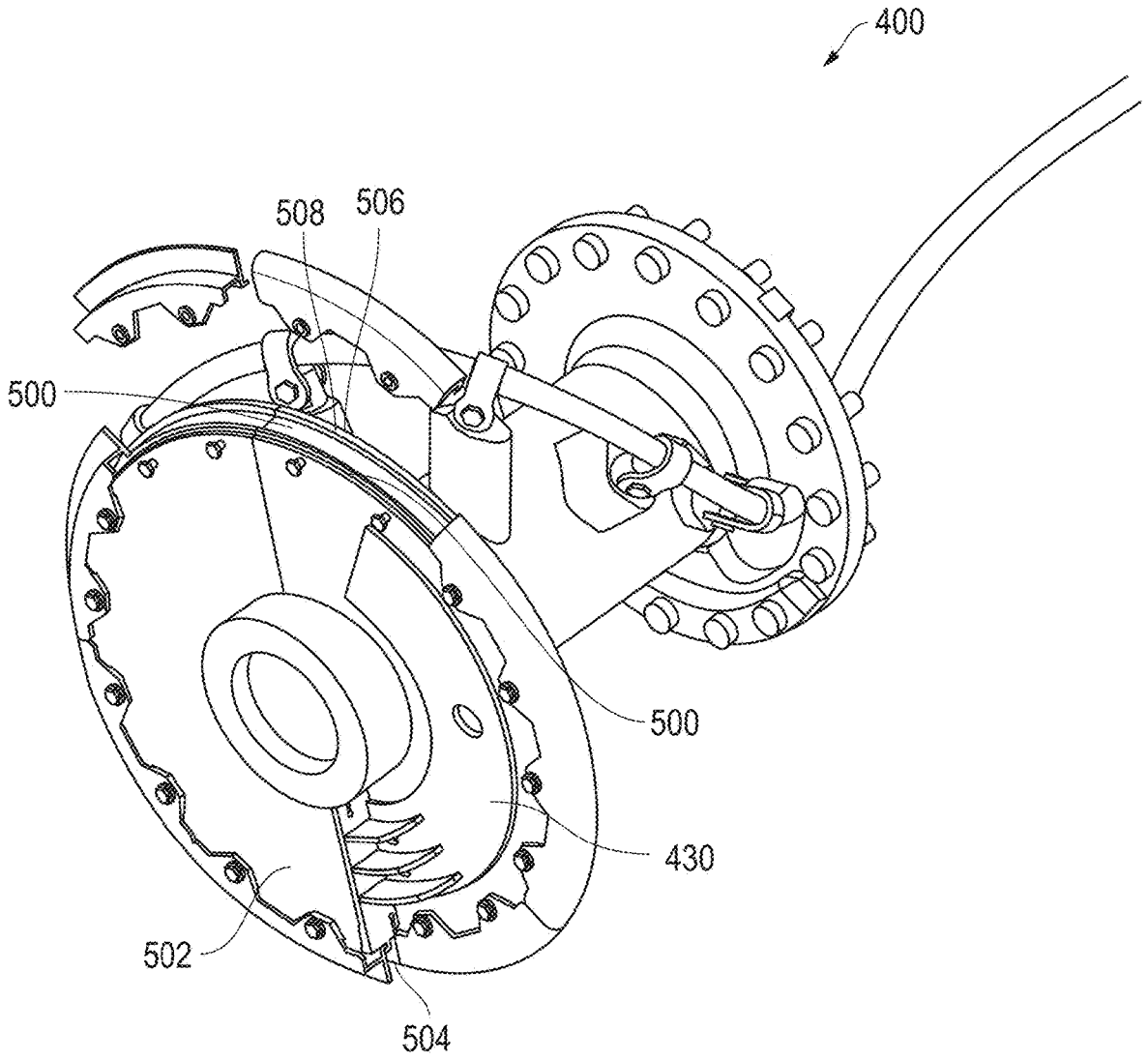
FIG. 27 includes a partially exploded, perspective view of a laying head in accordance with an embodiment.
Figure 28:
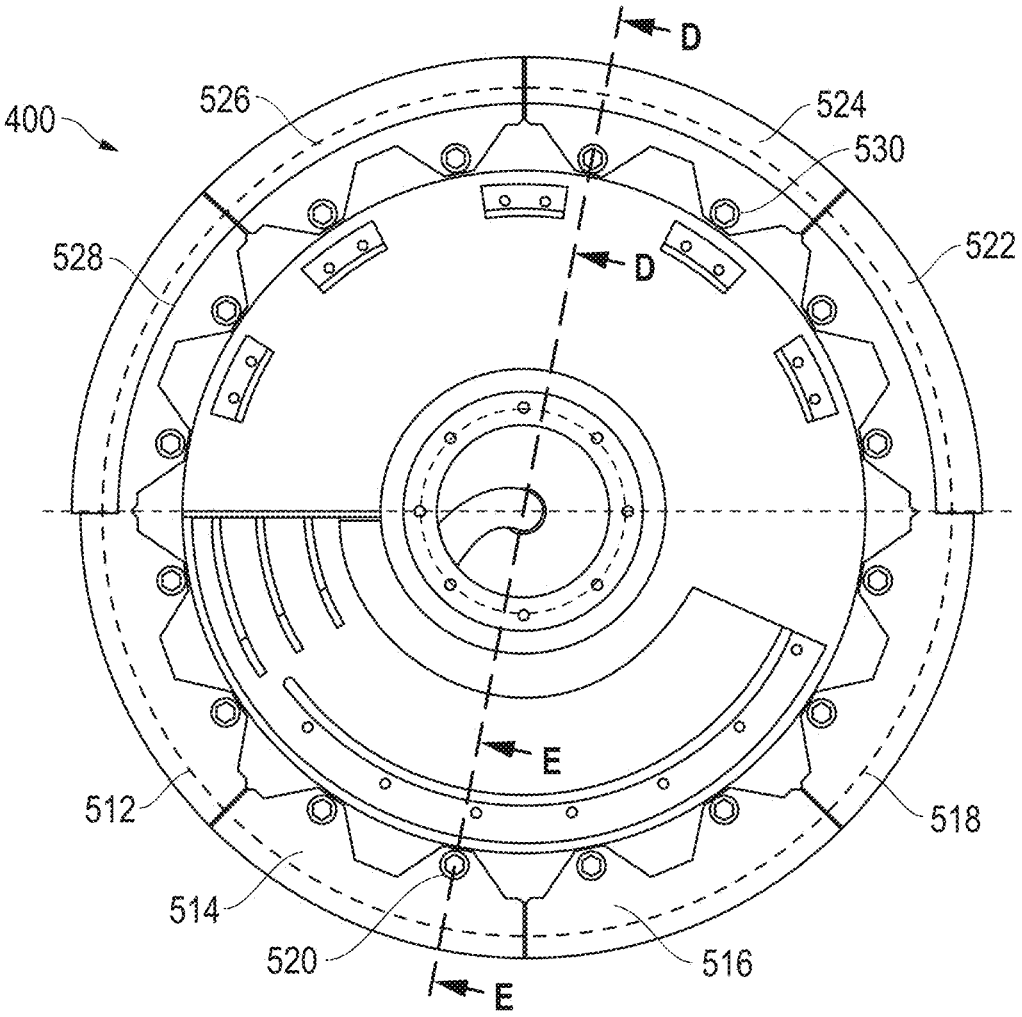
FIG. 28 includes a plan view of a laying head in accordance with an embodiment.

FIG. 27 and FIG. 28 show additional details of the split ring 430 and the segments attached to the outer periphery of the split ring 430 on the distal end 426 of the central support structure 420 of the laying head 404. As shown in FIG. 27, the split ring 430 can include a generally cylindrical peripheral wall 500 and a generally disc-shaped outer wall 502 formed with a split 504. FIG. 27 shows a generally L-shaped lip 506 extending radially outward from the peripheral wall 500 of the split ring 430 that can form a groove 508 around the peripheral wall 500 between the peripheral wall 500 and a portion of the L-shaped lip 506. FIG. 27 also shows that the split ring 430 can include a generally annular ridge 510 that can extend outward from the outer wall 502 along a direction parallel to the longitudinal axis 406 of the laying head assembly 400.

As shown in FIG. 28, the laying head 404 can include a first enclosed segment 512 affixed to the outer periphery of the split ring 430 of the distal end 426 of the central support structure 420 of the laying head 404. A second enclosed segment 514 can be affixed to the outer periphery of the split ring 430 of the distal end 426 of the central support structure 420 of the laying head 404. A third enclosed segment 516 can be affixed to the outer periphery of the split ring 430 of the distal end 426 of the central support structure 420 of the laying head 404. Further, a fourth enclosed segment 518 affixed to the outer periphery of the split ring 430 of the distal end 426 of the central support structure 420 of the laying head 404. As shown, each enclosed segment 512, 514, 516, 518 can be affixed to the outer periphery of the split ring 430 on the distal end 426 of the central support structure 420 of the laying head 404 using a pair of threaded fasteners 520.

FIG. 28 shows that the laying head 404 can also include a first open, single flanged segment 522 affixed to the outer periphery of the split ring 430 of the distal end 426 of the central support structure 420 of the laying head 404. A second open, single flanged segment 524 can be affixed to the outer periphery of the split ring 430 of the distal end 426 of the central support structure 420 of the laying head 404. A third open, single flanged segment 526 can be affixed to the outer periphery of the split ring 430 of the distal end 426 of the central support structure 420 of the laying head 404. Further, a fourth open, single flanged segment 528 affixed to the outer periphery of the split ring 430 of the distal end 426 of the central support structure 420 of the laying head 404. As shown, each open, single flanged segment 522, 524, 526, 528 can be affixed to the outer periphery of the split ring 430 on the distal end 426 of the central support structure 420 of the laying head 404 using a pair of threaded fasteners 530.

Figure 29:
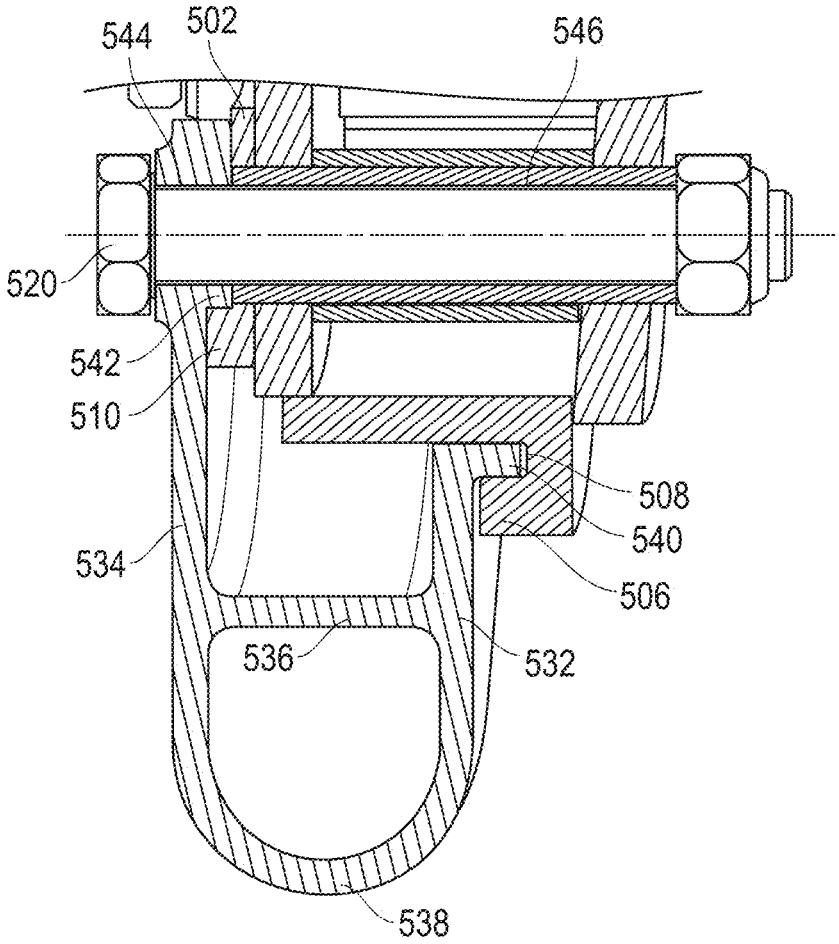
FIG. 29 includes a cross-section view of a laying head in accordance with an embodiment.

FIG. 29 illustrates a cross-sectional view of the split ring 430 of the distal end 426 of the central support structure 420 of the laying head 404. The cross-section is taken through the second enclosed segment 504, however, it is to be understood that each of the enclosed segments 502, 504, 506, 508 are substantially identical. As shown in FIG. 29, the enclosed segment 504 can include an inner wall 532 and an outer wall 534 connected by an interior lateral member 536. It is to be understood that the inner wall 532 and the outer wall 534 are substantially perpendicular to the longitudinal axis 406 of the laying head assembly 400. Conversely, the interior lateral member 536 is substantially parallel to the longitudinal axis 406 of the laying head assembly 400. Moreover, the inner wall 532 is relatively shorter than the outer wall 534.

As shown, the inner wall 532 and the outer wall 534 are also connected via an enclosed end 538. As shown, the enclosed end 538 can be generally semi-circular in shape as shown in cross-section. However, it can be appreciated that the enclosed end 538 can be triangular, rectangular, etc. FIG. 29 further indicates that the inner wall 532 of the second enclosed segment 504 can include a lateral flange 540 extending therefrom. The lateral flange 540 can extend away from the inner wall 532 in a direction substantially parallel to the longitudinal axis 406 of the laying head assembly 400. The outer wall 534 can include a mounting plate 542 extending therefrom. The mounting plate 542 can extend away from the outer wall 534 in the same direction as the lateral flange 540, i.e., substantially parallel to the longitudinal axis 406 of the laying head assembly 400.

As illustrated in FIG. 29, the enclosed segment 514 can engage the outer periphery of the split ring 430. Specifically, the lateral flange 540 that extends from the inner wall 532 of the enclosed segment 514 can fit into the groove 508 formed around the split ring 430 between the peripheral wall 500 and the L-shaped lip 506. Further, the mounting plate 542 can fit over the annular ridge 510 formed on the outer wall 502 of the split ring 430 and engage the outer wall 502 of the split ring 430. The threaded fastener 520 can pass through a bore 544 formed in the mounting plate 542 of the enclosed segment 514 and a bore 546 formed in the split ring 430.

FIG. 30 illustrates a cross-sectional view of the split ring 430 of the distal end 426 of the central support structure 420 of the laying head 404. The cross-section is taken through the second open, single flanged segment 514, however, it is to be understood that each of the open, single flanged segments 512, 514, 516, 518 are substantially identical. As shown in FIG. 30, the open, single flanged segment 514 can include an inner wall 552 and an outer wall 554 connected by a lateral member 556. It is to be understood that the inner wall 552 and the outer wall 554 are substantially perpendicular to the longitudinal axis 406 of the laying head assembly 400. Conversely, the lateral member 556 is substantially parallel to the longitudinal axis 406 of the laying head assembly 400. Moreover, the inner wall 552 is relatively shorter than the outer wall 554.

As illustrated in FIG. 30, the inner wall 552 of the second open, single flanged segment 504 can include a single radial flange 558 extending radially outward from the inner wall 552. Specifically, the single radial flange 558 is substantially perpendicular to the longitudinal axis 406 of the laying head assembly 400. FIG. 30 shows that the inner wall 552 of the second open, single flanged segment 504 can also include a lateral flange 560 extending therefrom. The lateral flange 560 is substantially perpendicular to the radial flange 558 and the lateral flange 560 can extend away from the inner wall 552 in a direction substantially parallel to the longitudinal axis 406 of the laying head assembly 400. As shown, the outer wall 554 can include a mounting plate 562 extending therefrom. The mounting plate 562 can extend away from the outer wall 554 in the same direction as the lateral flange 560, i.e., substantially parallel to the longitudinal axis 406 of the laying head assembly 400.

As illustrated in FIG. 30, the open, single flanged segment 524 can engage the outer periphery of the split ring 430.

Specifically, the lateral flange 560 that extends from the inner wall 552 of the open, single flanged segment 524 can fit into the groove 508 formed around the split ring 430 between the peripheral wall 500 and the L-shaped lip 506. Further, the mounting plate 562 can fit over the annular ridge 510 formed on the outer wall 502 of the split ring 430 and engage the outer wall 502 of the split ring 430. The threaded fastener 530 can pass through a bore 564 formed in the mounting plate 562 of the open, single flanged segment 524 and a bore 566 formed in the split ring 430.

As illustrated in FIG. 28, the enclosed segments 512, 514, 516, 518, collectively, can extend along the outer periphery of the split ring 430 at an angle, $ANG_{ES}$, and $ANG_{ES}$ can be greater than or equal to 135°. Further, $ANG_{ES}$ can be greater than or equal to 140°, such as greater than or equal to 145°, greater than or equal to 150°, greater than or equal to 155°, greater than or equal to 160°, greater than or equal to 165°, greater than or equal to 170°, or greater than or equal to 175°. In another aspect, $ANG_{ES}$ can be less than or equal to 225°, such as less than or equal to 220°, less than or equal to 215°, less than or equal to 210°, less than or equal to 205°, less than or equal to 200°, less than or equal to 195°, less than or equal to 190°, or less than or equal to 185°. It is to be understood that $ANG_{ES}$ can be within a range between and including any of the minimum and maximum values of $ANG_{ES}$ described herein.

Also, as illustrated in FIG. 28, the open, single flanged segments 522, 524, 526, 528, collectively, can extend along the outer periphery of the split ring 430 at an angle, $ANG_{OS}$, and $ANG_{OS}$ can be greater than or equal to 135°. Further, $ANG_{OS}$ can be greater than or equal to 140°, such as greater than or equal to 145°, greater than or equal to 150°, greater than or equal to 155°, greater than or equal to 160°, greater than or equal to 165°, greater than or equal to 170°, or greater than or equal to 175°. In another aspect, $ANG_{OS}$ can be less than or equal to 225°, such as less than or equal to 220°, less than or equal to 215°, less than or equal to 210°, less than or equal to 205°, less than or equal to 200°, less than or equal to 195°, less than or equal to 190°, or less than or equal to 185°. It is to be understood that $ANG_{OS}$ can be within a range between and including any of the minimum and maximum values of $ANG_{OS}$ described herein.

It can be appreciated that the laying head pipe 472 and the laying pathway therein can extend up to the first enclosed segment 512. A tail end pathway can be defined by the interior of each enclosed segment 512, 514, 516, 518 bound by the inner wall 532, the outer wall 534, and the enclosed end 538 of each segment 512, 514, 516, 518. Further, the tail end pathway can extend around the open, single flange segments 522, 524, 526, 528 along the open, single flange segments 522, 524, 526, 528 adjacent to the lateral member 556 and radial flange 558 of each of the open, single flange segments 522, 524, 526, 528. Accordingly, an elongated material can move through the laying head assembly 400, e.g., through the laying head pipe 472 along the laying pathway therein and around the split ring 430 through the tail end pathway defined by the enclosed segments 512, 514, 516, 518 and the open, single flange segments 522, 524, 526, 528. Thereafter, the elongated material can exit the laying head assembly 400 as consecutive rings, or coils, onto the conveyor 40 (FIG. 2).

The modular segments (enclosed 512, 514, 516, 518 and open 522, 524, 526, 528) can allow particular segments to be removed and replaced as they wear or get damaged. The limited number of segments 512, 514, 516, 518, 522, 524, 526, 528 reduces the number of segments substantially, which, in turn, increases the speed in which the segments can be replaced. This reduces down time of the roll mill, which, in turn, can increase production. This reduction in components on the split ring 430 also results in a substantial saving in maintenance costs. The segments 512, 514, 516, 518, 522, 524, 526, 528 can prevent a wire rod moving through the laying head assembly 400 from touching the split ring 430. This substantially reduces wear and tear on the split ring. Moreover, since wear and tear on the split ring 430 is reduced, the likelihood of an end of a wire rod passing through the enclosed segments catching on a wear spot or gap and being destroyed is also reduced.

Embodiments

Embodiment 1. A laying head assembly for the formation of coils comprising:

a laying head configured to rotate about an axis;

a pathway defining an enclosed conduit configured to contain an elongated material, the pathway extending in a helical path around the laying head; and at least one support structure coupling the pathway to the laying head, wherein the at least one support structure comprises a lateral profile area ($A_{lat}$) and a longitudinal profile area ($A_{long}$) and wherein the at least one support structure comprises a ratio [$A_{lat}/A_{long}$] of not greater than 1.

Embodiment 2. A laying head assembly for the formation of coils comprising:

a laying head configured to rotate about an axis;

a pathway defining an enclosed conduit configured to contain an elongated material, the pathway extending in a helical path around the laying head; and a plurality of support structures coupling the pathway to the laying head; and at least one void extending between the plurality of support structures or within the plurality of support structures, wherein the at least one void defines at least 5% of a total area between the laying head and the pathway.

Embodiment 3. A laying head assembly for the formation of coils comprising:

a laying head configured to rotate about an axis;

a pathway defining an enclosed conduit configured to contain an elongated material, the pathway extending in a helical path around the laying head; and at least one support structure coupling the pathway to the laying head, wherein at least one of the one or more couplings have an asymmetrical cross-sectional shape.

Embodiment 4. The laying head assembly of any one of embodiments 1 and 3, further comprising at least one void extending between a plurality of support structures or within the plurality of support structures, wherein the at least one void define at least 5% of a total area between the laying head and the pathway.

Embodiment 5. The laying head assembly of any one of embodiments 2 and 4, wherein the at least one void defines at least 10% of the total area or at least 20% or at least 30% or at least 40% or at least 50% or at least 60% or at least 70% or at least 80% or at least 90%.

Embodiment 6. The laying head assembly of any one of embodiments 2 and 4, wherein the at least one void defines not greater than 99% of the total area or not greater than 95% or not greater than 90% or not greater than 80% or not greater than 70% or not greater than 60% or not greater than 50%.

Embodiment 7. The laying head assembly of any one of embodiments 2 and 3, wherein the at least one support structure comprises a lateral profile area ($A_{lat}$) and a longitudinal profile area ($A_{long}$) and wherein the at least one support structure comprises a ratio [$A_{lat}/A_{long}$] of not greater than 1.

Embodiment 8. The laying head assembly of any one of embodiments 1 and 7, wherein the ratio $[A_{lat}/A_{long}]$ is not greater than 0.99 or not greater than 0.98 or not greater than 0.97 or not greater than 0.95 or not greater than 0.93 or not greater than 0.9 or not greater than 0.85 or not greater than 0.8 or not greater than 0.75 or not greater than 0.7 or not greater than 0.65 or not greater than 0.6 or not greater than 0.55 or not greater than 0.5 or not greater than 0.45 or not greater than 0.4 or not greater than 0.35 or not greater than 0.3 or not greater than 0.25 or not greater than 0.2 or not greater than 0.15 or not greater than 0.1 or not greater than 0.05.

Embodiment 9. The laying head assembly of any one of embodiments 1 and 7, wherein the ratio $[A_{lat}/A_{long}]$ is at least 0.01 or at least 0.03 or at least 0.05 or at least 0.08 or at least 0.1 or at least 0.15 or at least 0.2 or at least 0.25 or at least 0.3 or at least 0.35 or at least 0.4 or at last 0.45 or at least 0.5 or at least 0.55 or at least 0.6 or at least 0.65 or at least 0.7 or at least 0.75 or at least 0.8 or at last 0.85 or at least 0.9.

Embodiment 10. The laying head assembly of any one of embodiments 1, 2, and 3, wherein the at least one void is bounded by the laying head, laying head assembly pathway, and one or more support structures.

Embodiment 11. The laying head assembly of any one of embodiments 1, 2, and 3, wherein the at least one void includes a plurality of voids extending along a tortuous path of the laying head assembly pathway.

Embodiment 12. The laying head assembly of any one of embodiments 1, 2, and 3, wherein the at least one void includes a plurality of voids extending entirely through the at least one support structure.

Embodiment 13. The laying head assembly of any one of embodiments 1, 2, and 3, further comprising a plurality of support structures extending from the laying head in a tortuous pathway.

Embodiment 14. The laying head assembly of any one of embodiments 1, 2, and 3, wherein the at least one support structure is attached to the laying head at a proximal end and attached to the pathway at a terminal end opposite the proximal end.

Embodiment 15. The laying head assembly of any one of embodiments 1 and 2, wherein the at least one support structure has an asymmetrical shape relative to a longitudinal plane.

Embodiment 16. The laying head assembly of any one of embodiments 3 and 15, wherein the at least one support structure has an asymmetrical shape relative to a lateral plane.

Embodiment 17. The laying head assembly of any one of embodiments 3 and 15, wherein the at least one support structure has a trailing end extending in a lateral direction from a central region of the support structure.

Embodiment 18. The laying head assembly of embodiment 17, wherein the trailing end extends in a direction opposite an intended direction of rotation of the laying head and pathway.

Embodiment 19. The laying head assembly of embodiment 17, wherein the trailing end extends for a majority of a total length of the at least one support structure.

Embodiment 20. The laying head assembly of any one of embodiments 1, 2, and 3, wherein a plurality of the support structures have a trailing end.

Embodiment 21. The laying head assembly of embodiment 20, wherein each trailing end of the plurality of support structures has the same contour.

Embodiment 22. The laying head assembly of embodiment 20, wherein each trailing end of the plurality of support structures has a different contour.

Embodiment 23. The laying head assembly of any one of embodiments 1, 2, and 3, wherein the at least one support structure comprises an airfoil cross-sectional shape.

Embodiment 24. The laying head assembly of any one of embodiments 1, 2, and 3, further comprising a plurality of support structures and each support structure having a different cross-sectional shape compared to each other.

Embodiment 25. The laying head assembly of any one of embodiments 1, 2, and 3, further comprising a plurality of support structures and each support structure having a same cross-sectional shape compared to each other.

Embodiment 26. The laying head assembly of any one of embodiments 1, 2, and 3, wherein the pathway includes a proximal portion extending along an axis, a terminal portion displaced radially and axially from the proximal portion, and an intermediate portion extending between the proximal portion and terminal portion in arcuate path.

Embodiment 27. The laying head assembly of embodiment 26, further comprising a mill line for forming metal coupled to a proximal end of the pathway.

Embodiment 28. The laying head assembly of any one of embodiments 1, 2, and 3, wherein the pathway is an elongated hollow pathway configured to receive metal product and form the metal product into a helical formation of rings.

Embodiment 29. The laying head assembly of any one of embodiments 1, 2, and 3, wherein the pathway is a hollow body comprising a metal or metal alloy.

Embodiment 30. The laying head assembly of any one of embodiments 1, 2, and 3, wherein the pathway is configured to rotate about the axis with the laying head.

Embodiment 31. A laying head assembly for the formation of coils comprising:

a laying head assembly; and a pathway defining an enclosed conduit configured to contain an elongated material, the pathway extending circumferentially around a periphery of the laying head assembly, wherein the pathway extends around the periphery through an angle of less than 180°.

Embodiment 32. A laying head assembly for the formation of coils comprising:

a laying head assembly; and a pathway defining a channel configured to contain an elongated material, the pathway extending circumferentially around a periphery of the laying head assembly, wherein the pathway defines a helical shape having a non-constant radius of curvature.

Embodiment 33. A laying head assembly for the formation of coils comprising:

a laying head assembly;

a split ring coupled to a laying head assembly shroud; and a pathway defining an enclosed conduit configured to isolate an elongated material from contact with the split ring, the pathway extending circumferentially around a periphery of the laying head assembly and defining a helical shape having an increasing radius of curvature Embodiment 34. The laying head assembly of any one of embodiments 31, 32, and 33, wherein at least a portion of an interior surface defining the pathway comprises a wear resistant coating.

Embodiment 35. The laying head assembly of embodiment 34, wherein the wear resistant coating comprises boron.

Embodiment 36. The laying head assembly of any one of embodiments 31, 32, and 33, wherein the pathway comprises a plurality of segments disposed adjacent to each other and each of the segments of the plurality of segments are coupled to the laying head assembly.

Embodiment 37. The laying head assembly of embodiment 36, wherein at least one segment of the plurality of segments is coupled to the laying head assembly by a fastener.

Embodiment 38. The laying head assembly of embodiment 37, wherein the at least one segment extends around the periphery of the laying head assembly through an angle of at least about 5° and not greater than 175°.

Embodiment 39. The laying head assembly of embodiment 36, wherein each of the segments of the plurality of segments has the same length relative to each other.

Embodiment 40. The laying head assembly of embodiment 36, wherein at least one segment of the plurality of segments has a different length relative to another segment of the plurality of segments.

Embodiment 41. The laying head assembly of embodiment 32, wherein the channel is an enclosed conduit.

Embodiment 42. The laying head assembly of any one of embodiments 32 and 33, wherein the pathway extends around the periphery of the laying head assembly through an angle of less than 180°.

Embodiment 43. The laying head assembly of any one of embodiments 31 and 42, wherein the pathway extends around the periphery of the laying head assembly through an angle of not greater than 179°, not greater than 178°, not greater than 177°, not greater than 176°, not greater than 175°, not greater than 174°, not greater than 173°, not greater than 172°, not greater than 171°, not greater than 170°, not greater than 165°, not greater than 160°, not greater than 150°, not greater than 140°, not greater than 130°, not greater than 120°, not greater than 115°, not greater than 110°, not greater than 100°, not greater than 95°, not greater than 90°, not greater than 85°, not greater than 80°, not greater than 75°, not greater than 70°, not greater than 65°, not greater than 60°.

Embodiment 44. The laying head assembly of any one of embodiments 31 and 42, wherein the pathway extends around the periphery of the laying head assembly through an angle of at least about 10°, at least about 20°, at least about 30°, at least about 40°, at least about 50°, at least about 60°, at least about 70°, at least about 80°, at least about 90°, at least about 100°, at least about 110°, at least about 120°, at least about 130°, at least about 140°, at least about 150°, at least about 160°.

Embodiment 45. The laying head assembly of embodiment 31, wherein the pathway defines a helical shape having a non-constant radius of curvature.

Embodiment 46. The laying head assembly of any one of embodiments 32 and 33, wherein the pathway extends circumferentially around a periphery of the laying head assembly and defines a helical shape having an increasing radius of curvature.

Embodiment 47. The laying head assembly of embodiment 46, wherein the increasing radius of curvature defines a difference in radius of at least 0.5% as measured by the radius of curvature at an initial point on the pathway and a terminal point on the pathway, wherein the difference in radius is at least 0.6% or at least 0.7% or at least 0.8% or at least 0.9% or at least 1% or at least 1.2% or at least 1.5% or at least 1.8% or at least 2% or at least 2.2% or at least 2.5% or at least 2.8% or at least 3% or at least 3.5% or at least 4% or at least 4.5% or at least 5% or at least 6% or at least 7% or at least 8% or at least 9% or at least 10%.

Embodiment 48. The laying head assembly of embodiment 47, wherein increasing radius of curvature defines a difference in radius of not greater than 50% as measured by the radius of curvature at an initial point on the pathway and a terminal point on the pathway, wherein the difference in radius is not greater than 40% or not greater than 30% or not greater than 20% or not greater than 18% or not greater than 15% or not greater than 13% or not greater than 10% or not greater than 9% or not greater than 8% or not greater than 7% or not greater than 6% or not greater than 5% or not greater than 4% or not greater than 3% or not greater than 2%.

Embodiment 49. The laying head assembly of embodiment 46, wherein the increasing radius of curvature is at least 2 mm different between an initial point on the pathway and a terminal point on the pathway.

Embodiment 50. The laying head assembly of any one of embodiments 31, 32, and 33, wherein the pathway defines an average interior width of at least 4 mm and not greater than 50 mm.

Embodiment 51. The laying head assembly of any one of embodiments 31, 32, and 33, wherein the pathway comprises a cross-sectional shape selected from the group of shapes including ellipsoid, circular, polygon, irregular polygon, or a combination thereof.

Embodiment 52. The laying head assembly of any one of embodiments 31, 32, and 33, further comprising a laying head assembly pipe coupled to the pathway.

Embodiment 53. The laying head assembly of embodiment 52, wherein the pathway defines an elongated hollow pathway adapted to transport elongated materials therein, and wherein the laying pathway structure comprises a proximal portion extending along an axis, a terminal portion displaced radially and axially from the proximal portion, and an intermediate portion extending between the proximal portion and terminal portion in arcuate path.

Embodiment 54. The laying head assembly of embodiment 52, wherein the pathway comprises a terminal portion coupled to an initial end of the pathway.

Embodiment 55. The laying head assembly of embodiment 52, wherein the pathway comprises a terminal portion coupled to an initial end of the enclosed conduit.

Embodiment 56. The laying head assembly of any one of embodiments 31, 32, and 33, wherein the laying head assembly is configured to rotate about an axis.

Embodiment 57. The laying head assembly of any one of embodiments 31, 32, and 33, further comprising a supporting structure configured to support the laying head assembly.

Embodiment 58. The laying head assembly of any one of embodiments 31, 32, and 33, further comprising a split ring coupled to the laying head assembly and configured to overlie at least a portion of the pathway.

Embodiment 59. The laying head assembly of any one of embodiments 31, 32, and 33, wherein the pathway is coupled to a terminal end of a quill having a generally bell-shaped contour, and the pathway is fastened to the peripheral bottom surface of the quill.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A laying head assembly for the formation of coils comprising:

a laying head configured to rotate about an axis;

a pathway defining an enclosed conduit configured to contain an elongated material, the pathway extending in a helical path around the laying head; and at least one support structure coupling the pathway to the laying head, wherein the at least one support structures comprises an airfoil cross-sectional shape.

2. The laying head assembly of claim 1, wherein the at least one support structure has a trailing end extending in a lateral direction from a central region of the support structure.

3. The laying head assembly of claim 2, wherein the trailing end extends in a direction opposite an intended direction of rotation of the laying head and pathway.

4. The laying head assembly of claim 2, wherein the trailing end extends for a majority of a total length of the at least one support structure.

5. The laying head assembly of claim 1, further comprising a plurality of support structures and each support structure having a same cross-sectional shape compared to each other.

6. The laying head assembly of claim 1, further comprising a plurality of support structures and each support structure having a different height compared to each other.

7. A laying head assembly for the formation of coils comprising:

a laying head configured to rotate about an axis;

a pathway defining an enclosed conduit configured to contain an elongated material, the pathway extending in a helical path around the laying head; and a plurality of support structures coupling the pathway to the laying head, wherein each support structure comprises an airfoil cross-sectional shape compared to each other; and at least one void extending between the plurality of support structures or within the plurality of support structures, wherein the at least one void defines at least 5% of a total area between the laying head and the pathway.

8. The laying head assembly of claim 7, wherein the at least one void defines at least 10% of the total area or at least 20% or at least 30% or at least 40% or at least 50% or at least 60% or at least 70% or at least 80% or at least 90%.

9. The laying head assembly of claim 7, wherein the at least one void defines not greater than 99% of the total area or not greater than 95% or not greater than 90% or not greater than 80% or not greater than 70% or not greater than 60% or not greater than 50%.

10. The laying head assembly of claim 7, wherein the at least one void is bounded by the laying head, laying head assembly pathway, and one or more support structures.

11. The laying head assembly of claim 7, wherein the at least one void includes a plurality of voids extending along a tortuous path of the laying head assembly pathway.

12. The laying head assembly of claim 7, wherein the at least one void includes a plurality of voids extending entirely through the at least one support structure.

13. A laying head assembly for the formation of coils comprising:

a laying head configured to rotate about an axis;

a pathway defining an enclosed conduit configured to contain an elongated material, the pathway extending in a helical path around the laying head; and at least one support structure coupling the pathway to the laying head, wherein the at least one support structure comprises a lateral profile area ($A_{lat}$) and a longitudinal profile area ($A_{long}$) wherein the at least one support structure comprises a ratio [$A_{lat}/A_{long}$] of not greater than 1, and wherein the at least one support structure is oriented such that a longitudinal axis of each support structure is perpendicular to a longitudinal axis of the laying head assembly about which the laying head assembly rotates, and wherein the at least one support structure has an asymmetrical cross-sectional shape about its longitudinal axis.

14. The laying head assembly of claim 13, wherein the ratio [$A_{lat}/A_{long}$] is not greater than 0.99 or not greater than 0.98 or not greater than 0.97 or not greater than 0.95 or not greater than 0.93 or not greater than 0.9 or not greater than 0.85 or not greater than 0.8 or not greater than 0.75 or not greater than 0.7 or not greater than 0.65 or not greater than 0.6 or not greater than 0.55 or not greater than 0.5 or not greater than 0.45 or not greater than 0.4 or not greater than 0.35 or not greater than 0.3 or not greater than 0.25 or not greater than 0.2 or not greater than 0.15 or not greater than 0.1 or not greater than 0.05.

15. The laying head assembly of claim 13, wherein the ratio [$A_{lat}/A_{long}$] is at least 0.01 or at least 0.03 or at least 0.05 or at least 0.08 or at least 0.1 or at least 0.15 or at least 0.2 or at least 0.25 or at least 0.3 or at least 0.35 or at least 0.4 or at least 0.45 or at least 0.5 or at least 0.55 or at least 0.6 or at least 0.65 or at least 0.7 or at least 0.75 or at least 0.8 or at least 0.85 or at least 0.9.

16. The laying head assembly of claim 13, further comprising a plurality of support structures extending from the laying head in a tortuous pathway.

17. The laying head assembly of claim 13, wherein the at least one support structure is attached to the laying head at a proximal end and attached to the pathway at a terminal end opposite the proximal end.

18. The laying head assembly of claim 13, wherein the at least one support structure has an asymmetrical airfoil shape.

* * * * *